United States Patent [19]

Byrd

[11] 4,026,402

[45] May 31, 1977

[54] INCREMENTAL LINE PRINTER

[75] Inventor: William Jerry Byrd, Nashua, N.H.

[73] Assignee: Centronics Data Computer Corporation, Hudson, N.H.

[22] Filed: July 28, 1975

[21] Appl. No.: 599,679

[52] U.S. Cl. ..... 197/1 R; 197/19; 197/176; 178/30; 340/172.5; 197/82

[51] Int. Cl.[2] ..... B41J 3/04

[58] Field of Search ..... 197/1 R, 19, 20, 82 R, 197/84 R, 91, 176, 177, 178, 179; 235/61.9 R; 340/172.5, 174; 178/23 R, 26 R, 30

[56] References Cited

UNITED STATES PATENTS

| | | | |
|---|---|---|---|
| 3,703,949 | 11/1972 | Howard et al. | 197/19 X |
| 3,719,781 | 3/1973 | Fulton et al. | 178/30 |
| 3,764,993 | 10/1973 | Lettieri | 340/172.5 |
| 3,831,728 | 8/1974 | Woods et al. | 197/1 R |
| 3,832,697 | 8/1974 | Kashio | 197/176 X |
| 3,844,395 | 10/1974 | Merd et al. | 197/1 R |
| 3,858,703 | 1/1975 | Duley | 197/1 R |
| 3,885,663 | 5/1975 | Suzuki | 197/176 |
| 3,893,558 | 7/1975 | Fulton et al. | 197/1 R |
| 3,923,139 | 12/1975 | Mesnil et al. | 197/19 |

*Primary Examiner*—Ralph T. Rader
*Attorney, Agent, or Firm*—Ostrolenk, Faber, Gerb & Soffen

[57] ABSTRACT

An incremental impact printer of the dot matrix type. Binary words representative of data to be printed along a line of print may be accepted from either the printer keyboard or the output of a computer or other source. The printer electronics provides for either a single character or a burst of characters to be substantially instantaneously printed upon receipt. The print head is always moved to the right of the last character printed to facilitate observation of that character. The next character is printed by first moving the print head to the left of the last character printed and then abruptly reversing the print head to print one or a burst of characters "on the fly". A novel registration system serves the dual function of accurately locating the proper position for a character to be printed and determining the direction of movement of the print head at any given instant. The printer has a capability of receiving characters at a rate of 75,000 characters per second and of printing at a rate of up to 120 characters per second. The device can also be utilized in the transmission mode with the transmission rate through communication of other links being a function of the operator's typing speed. The printer is further capable of simultaneously accepting data while performing a printing operation.

8 Claims, 23 Drawing Figures

STROBE
PRNCAR
+5V DC
CLCTRA
PRNMC2
LOAD
UP
DWN
CLOIFR
FORWARD
CHANC2
CHIOSC
CH2OSC
FORWAS
PULFOR
PULREV
PRNMC1
CHANO1
CHANO2
LE
LV+FF
(LV+FF)·LE
+5V
+0V
±0V
R3
R4
R51
R56
R57
R58
C17
C24
C25
C27
C28

FOR → REV
$t_r$

NORMAL FORWARD OPERATION
CHAN01
CHAN02
CH10SC
CH20SC
$\overline{CHANC2}$
LE
LV
PUL
$\overline{CHANC2}$
$(LV^{\vee}\overline{FF})$-LE
$(\overline{LV^{\vee}FF})$-LE
$\overline{FORWARD}$
$\overline{FORWARD}$
$t_1$
$t_2$
$t_3$
$t_4$
$t_5$
$t_6$
$\delta_3$
$\delta_2$ FOR → REV → FOR
CH #1
CH #2
CH#1CE
CH#2CE
FF1
LE
LV
LV≠FF
(LV≠FF)
(LV≠FF)
LVFFLE
FORWARD
1
2
C9-94
F=1 1 2 7 4 1 2 7 7 5 0 3 4 5 0 0 2 7 4 1 2 7 7 5 0 3 6 5 0
LE D9-11
LE E9-11
E 8-12
5 0 1 2 1 0 15 0 1 2 1 0 15
$t_{r_1}$ $t_{r_1}$ +90°
$t_{r_2}$ $t_{r_2}$ +90°
$t_{r_3}$ $t_{r_3}$ +90°

TB1
TB2
TB3
TB4
TB5
TB6
TB7
TB8
DATPCH
DACLOH
±0V
CL
209
206
206A
207B
206a
PRIME
DS1
DS2
DS3
DS4
DS5
DS6
DS7
DS8
205
PRIME 3
DATA01
DATA02
DATA03
DATA04
DATA07
DATA08
374c
377
205a
DATAAV
374e
PRIME3
374a
374
374d
373c
374b
373
373a
373b
371
376
370
ALNDAT
REMSEL
DAPOLD
MASOSC
DST A
DATA AV
ALNDAT
REDESL
REMSEL
DATAAV
DELPRI
PASEST
349
PAOURD
348
R25
PE
354
SEL
346
352
351
345
58
59
57
55
R24
+5V
PAPER OUT
OVRRID
RTPSW
EOPSW
RTP
362
361
STROBE
368
CH2OSC
367
PWRPRI
EOP
FAULT
358
OSCXT
360
BUFFER FULL
356
357
LD
SEL
PE
BUSY
364
364c
364d
364a
370
R26
C7

INCREMENTAL LINE PRINTER

The present invention relates to impact printers of the dot matrix type and more particularly to printers capable of receiving data from either a local keyboard or communications link and of simultaneously receiving such data while the printing operations are being performed.

BACKGROUND OF THE INVENTION

Line printers have been in use for quite some time and have been utilized in a wide variety of applications. One particular application is in the field of teletypewriters which are employed to simultaneously print hard copies of a message as the message is being transmitted through a communications link. Printers of this type also have a capability of accepting data received from a remote facility. Devices of this category typically employ either hammer type keys as are found in conventional typewriters or, alternatively, employ cylindrical drum type members, either of which devices print an entire character by impacting the selected type font against the ribbon which transfer ink to the paper document in the configuration of the type font which strikes the inked ribbon. Devices of this category utilize a cooperating ratchet and feed pawl arrangement which incrementally steps the type font relative to the paper document for proper positioning of each character printed.

Printing under control of either the local keyboard or the local or remote communications link is limited by the printing speed of the printer which is capable of receiving only one coded character at a time and printing the character represented by the received code word.

BRIEF DESCRIPTION OF THE INVENTION

The present invention is characterized by providing a novel printer which completely eliminates the need for incremental stepping of the printing mechanism relative to the paper document and further permits the receipt of code words transmitted to the printer at a rate faster than the fastest printing speed, thereby enabling code words to be received and stored simultaneously with the occurrence of a printing operation.

The printer has a storage capability of storing 133 data words in a recirculate memory which words may represent command codes, as well as printable characters and/or symbols. The received data is loaded into an input holding register. A data load control checks to insure that the data memory is lined up ready to accept additional data and further to assure that the input data is not a delete code, a select code or a de-select code. When all of these conditions are satisfied, data load control loads the data word into data memory as well as data available and position information which is simultaneously transferred into the data location memory. A data extract control means detects the data in memory and circulates the data memory until the data word is picked off and loaded into an output holding register while the shift register is aligned ready to accept additional information. During this time the data location memory register is also circulated and the data is extracted from the data memory and the data available information is extracted from the data location memory.

The data-available memory is a multi-stage shift register which provides four binary code combinations for keeping track of data in the recirculate memory, which codes are:

1. No data in the data position (00).
2. Data in the data position (10).
3. Data in the dummy position (01).
4. Dummy in the dummy position (11).

These four codes provide information as to where the data is located in the recirculate memory at all times and enable the detection of an overfilled condition of the recirculate data memory. When the printer is initially primed, the prime control inserts a predetermined number (preferably 16) of dummy characters into the data available memory. These dummy characters provide an indication of when the data memory is filled with code words equal in number to the capacity of the data memory minus the predetermined number of dummy characters. At such time a buffer full signal is transmitted to the outside world indicating the existence of a buffer full condition. It is still possible, however, to accept additional number of code words equal in number to the predetermined number of dummy characters without actually overrunning the data memory. The data full condition is not released until a number of code words have been read out of data memory and printed, which number is of the order of twice the number of dummy characters originally stored in the data location memory.

In order to totally eliminate mechanical apparatus employed in conventional teleprinters for accurately positioning the printing means relative to the paper document, novel registration means are employed which comprise a registration strip having a predetermined code pattern thereon and an optical pick-up assembly. Relative movement between the optical assembly and registration strip enables the optical assembly to scan the registration strip pattern to generate two signals which are 90° out of phase. A pulse is generated on the leading and trailing edge of both of the video pulses developed by the optical assembly. Electronic print head direction indicator means examines the past position, present position and future position of the print head to determine whether the head is moving in the forward or reverse direction. The head direction indicator means will not accept two subsequent pulses from the same channel of the optical means unless it has received one pulse from the other channel in the interim. A column position counter accepts the forward or reverse information which respectively either increments or decrements the counter with one of the pulses outputted from the optical assembly.

The column position counter counts in steps of six wherein three slots of the registration strip are counted, after which time the counter zeros itself and at the same time clocks a character print position counter. When the print head changes direction it will count through zero plus five before again zeroing itself and clocking the character print position counter in the direction of print head motion. When the printer is printing a character, the character print position counter clock is clocked to provide a unique count for each print position. A strobe generator is enabled whenever the unique count is achieved with the print head moving in the forward direction and is disabled once the character is printed if the memory is devoid of data representing a character or other symbol to be printed.

The printer has a further capability of automatically setting and cancelling horizontal tabs. When initialized, the printer is adapted to load a dummy character into the tab memory, which dummy character is recognized as the end of a line. The dummy character, when detected at the output of the tab shift register, automatically deenergizes the brake and forward clutch causing the print head to be returned abruptly to the left-hand margin (for example, by charged return spring means). Set tabs are loaded into the tab memory when an escape code (ESC) followed by a DC1 code is transmitted to the printer. A clear tab is loaded into the tab memory when an escape code (ESC) is followed by a DC2 code. The tab is initialized when a tab code is transmitted to the printer. The tab code, when recognized, releases the brake causing the print head to move to the left. As the print head passes the next print position (detected by the registration means) the forward clutch is energized to advance the print head toward the right until it detects the tab position at the output of the tab memory causing the forward clutch to be deenergized and causing the brake to be energized. If another tab is received at this time, the same sequence of events will occur. The brake turns off and the print head moves to the left until the next position is detected, at which time the forward clutch is energized and the print head is advanced to the right until the next tab position is detected. If the tab function is detected and there are no other tab positions between the present position and the printer end of print (EOP) switch, the print head advances to the end of the line, at which time either the EOP switch or the end of line code is detected causing the forward clutch to turn off. The brake remains released causing the print head to move to the left until it actuates the ready to print (RTP) switch, at which time the print head terminates a search for a tab position.

Printing is of the dot matrix impact type in which a predetermined number of dot columns are sequentially printed to form each character or symbol. Upon the completion of the printing of each character or a burst of characters, the print head, comprised of a plurality of solenoid control print wires, is brought to a halt in what may be characterized as a non-abrupt manner so that the print head is positioned to the right of the last printed character enabling that character to be observed by the operator. Upon the transfer of the next code word or burst of code words to the data memory, the print head is moved to the left of the last printed character, usually by an amount equivalent to the space of two or three character widths and is then abruptly halted and moved in the forward or print direction. Due to the utilization of the novel registration means, the printing of the next character or burst of characters is performed on the fly, whereupon the print head is more or less "coasted" to a stop after the present character or burst of characters has been printed, again occupying a position which is of the order of ten to twelve dot column widths to the right of the last printed character or symbol, the exact position at which the print head is halted being immaterial due to the accuracy imparted to the printer by the novel registration means.

The printer, in one preferred embodiment, is capable of receiving characters transmitted thereto at a rate of up to 75,000 character codes per second and is capable of printing up to 120 characters per second.

BRIEF DESCRIPTION OF THE FIGURES AND OBJECTS

It is therefore one object of the present invention to provide a novel input/output incremental printer capable of simultaneously printing characters of the dot matrix type from received data at the same time that additional data is being received.

Still another object of the present invention is to provide a novel incremental printer, preferably of the dot matrix type, which eliminates the need for a precision mechanical stepping means which normally provides relative motion between the print elements and the paper document, by substituting therefore novel registration means which precisely determines the position of the print head enabling printing to occur on the fly so as to eliminate the need for abruptly and precisely halting the printing elements upon the termination of printing of a character.

Still another object of the present invention is to provide a novel input/output type incremental printer having electronic tab means enabling the performance of high speed tab setting and resetting operations and high speed horizontal tab operations.

The above as well as other objects of the present invention will become apparent when reading the accompanying description and drawings in which:

FIG. 1 is a perspective view of a printer embodying the principles of the present invention.

FIG. 1*a* is a perspective view of the printer of FIG. 1 with the covers removed.

FIG. 1*b* shows a plan view of the registration strip.

FIG. 1*c* is a plan view showing an enlarged portion of the registration strip of FIG. 1*b*.

FIGS. 1*d* and 1*e* are end and sectional views of the optical assembly employed with the registration strip of FIG. 1*b*.

FIG. 2 is a block diagram generally showing the electronics employed in the printer of FIG. 1.

FIG. 2*a* is a block diagram showing the absolute position decoder electronics of the printer of FIG. 1.

FIGS. 2*b*, 2*d*, 2*e*, and 2*f* are waveform diagrams useful in explaining the operation of the head direction indicator.

FIG. 2*c* is a schematic showing the head direction indicator in greater detail.

FIG. 2*g* is a schematic diagram of the character print position counter and related circuitry.

FIGS. 3*a* and 3*b* are schematic diagrams showing some of the function code detection circuitry in greater detail.

FIGS. 3*c* and 3*d* are schematic diagrams showing the data and data available memories in greater detail.

FIG. 3*e* is a schematic diagram showing the digital display circuitry for displaying the column position number.

FIG. 3*f* is a schematic diagram showing the manner in which the printer is initialized.

FIG. 3*g* is a schematic diagram showing the manner in which the printer is initialized.

FIG. 4 is a block diagram showing the tab control circuitry.

FIG. 4*a* is a block diagram showing the data and data position memories and the control circuits therefor.

DETAILED DESCRIPTION OF THE INVENTION

Figure 1:
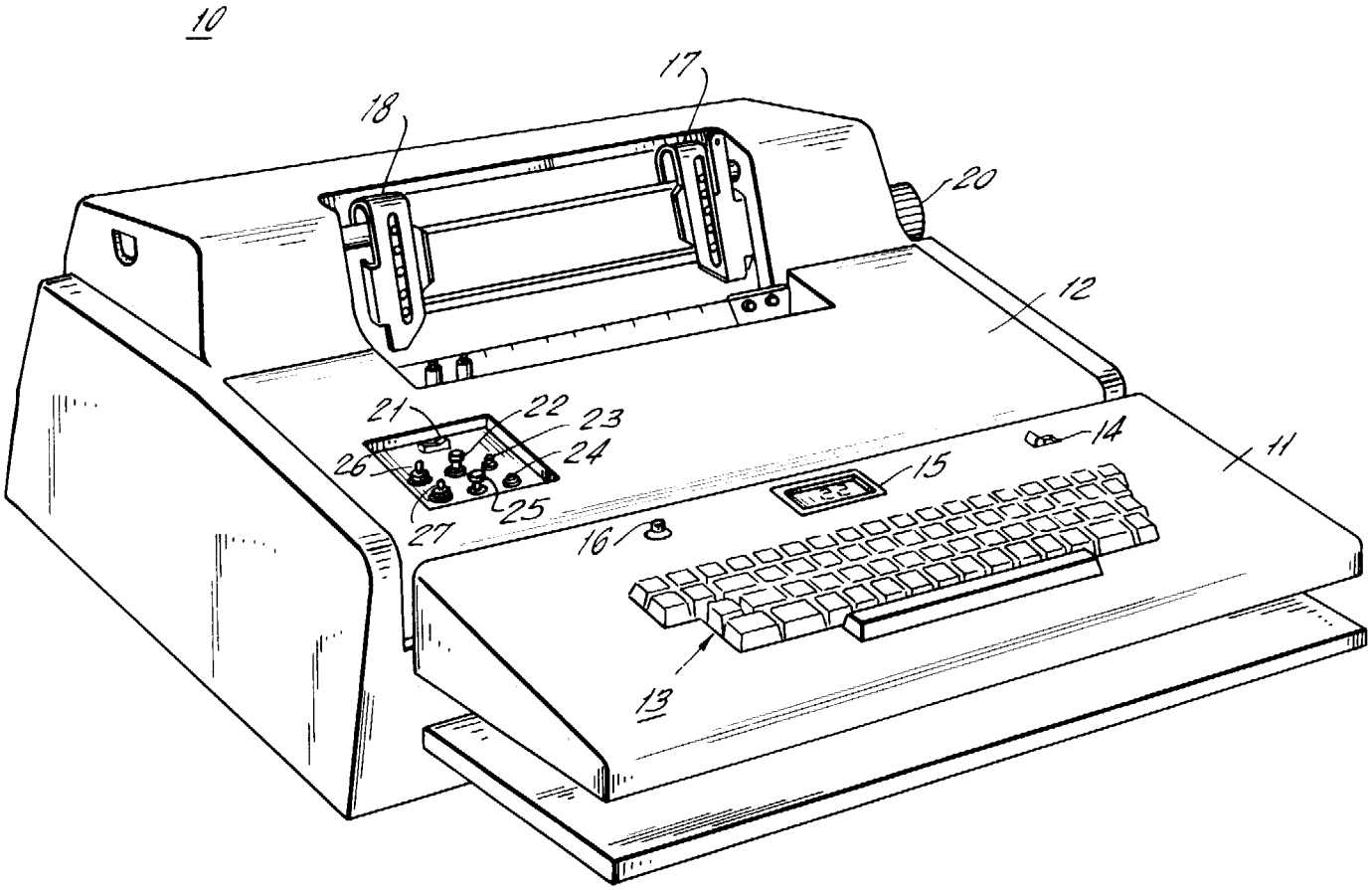

FIG. 1 is a perspective view of the printer 10 comprised of a keyboard housing 11 and printer mechanical and electronics housing 12. Keyboard 11 is provided with a set of keys 13, a local/remote switch 14, a column indicator display 15 comprised of a segmented lamp display and a ready indicator lamp 16. Local/-remote switch 14 is a two-position switch which, when in the local position, couples the keyboard to the printer. In the remote position, the keyboard is coupled to an external device such as, for example, a computer or other facility and data from the external device is coupled directly to the printer. Display 15 provides an illuminated numeric indication of the column position of the print head at any given instant of time. Relay indicator lamp 16 is illuminated when the printer electronics have been initialized and the printer is ready to assume operation under either the local or remote condition. The keyboard contains the standard alphabetic, numeric and symbol character keys, as well as function keys.

The printer is comprised of a set of tractor assemblies 17 and 18 for advancing the paper document which is typically an elongated web of indeterminate length provided with spaced apertures along its left and right-hand margins which receive the tractor pins to advance the web in positive non-slip fashion. The platen knob 20 permits manual movement of the tractor assembly for both loading and positioning of the paper document under manual control. On/Off switch 21 is utilized to turn the printer on or off. Select switch 22 is employed to select the printer after turning on power. Select indicator lamp 23 is illuminated to indicate that the printer has been selected. Paper/Empty lamp 24 becomes illuminated to indicate an out-of-paper condition or a paper handling malfunction. The forms override switch 25 enables the printer operation to override an internal paper-out switch. Line feed switch 26 enables an operator to perform manual line feeds of the paper document. Top of form switch 27 enables the paper document to be slewed to the "top of form" position.

Figure 1A:
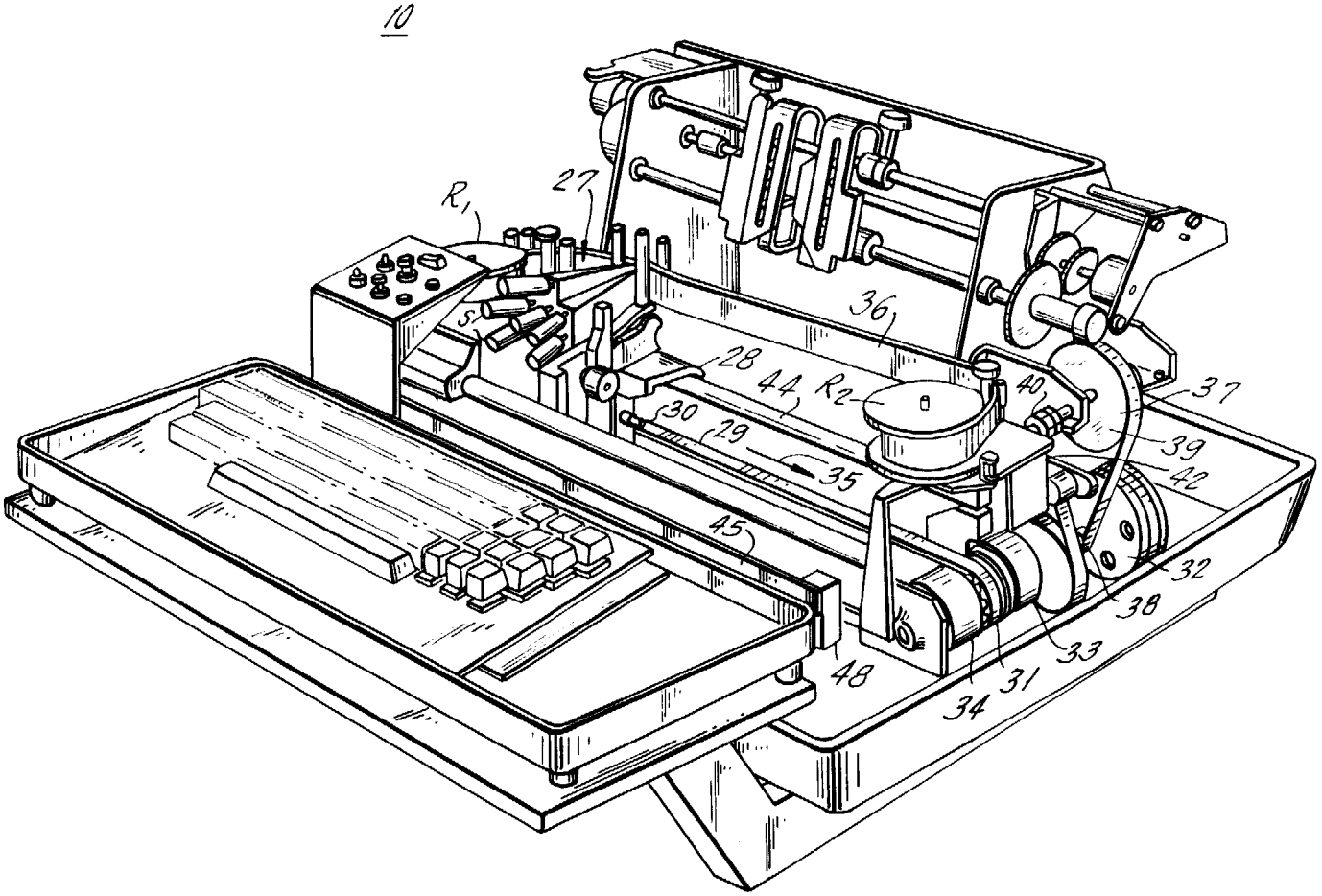

FIG. 1*a* shows the printer device 10 with the housings removed. A print head assembly 27 is mounted upon carriage 28 which is slidably supported by a pair of guide rods 43 and 44. The print head assembly is provided with seven solenoids S each utilized to selectively print one of seven vertically aligned dots, hereinafter referred to as a "dot column". The opposite sides of carriage 28 are connected to a closed loop timing belt 29 by clamp means 30, only one of which is shown in FIG. 1*a*. Belt 29 is entrained about a pair of timing gears 31 arranged on opposite sides of the carriage, only one of which is shown in FIG. 1*a* for purposes of simplicity. Belt 31 is driven by motor 32 which is selectively coupled to timing gear 31 by selectively energizable electromagnetic clutch means 33. The timing belt and hence the printer carriage and print head may be abruptly brought to a halt by means of electromagnetic brake 34. Elongated spring means (not shown) are provided whereby one end of the elongated spring means is coupled to the printer frame while the opposite end is coupled to carriage 28. The spring functions to rapidly drive the carriage 28 in the left-hand direction (when the clutch 33 and brake 34 are disengaged) preparatory to the next printing operation, wherein printing occurs by movement of the print head from left to right. With motor 32 energized and clutch 33 engaged, timing belt 29 is moved to the right as shown by arrow 35 thereby moving the carriage 28 and print head 27 in the "printing direction". Printing occurs on the fly wherein the print head solenoids S are selectively energized as the print head is moving across the paper document. As soon as a line of print is completed, the clutch assembly is disengaged. As the print head is moved to the right, the spring means becomes elongated. With the clutch disengaged, the elongated spring serves to rapidly drive the carriage back towards the left-hand margin of the paper document in readiness for the next print operation.

The dot column patterns are formed upon the paper document as a result of the solenoid print wires impacting ribbon 36 which is positioned across the paper document and is entrained about ribbon reels R1 and R2. The ribbon is advanced by ribbon advance mechanism 36 comprised of a timing belt 37 entrained about the motor output gear 38 and timing gear 39 whose output is coupled through shaft 40 and belt 41 to a ribbon advancement mechanism 42 for rotating reel R2 clockwise (for example). Thus, the ribbon 36 may be wound about reel R2 as it is being unwound from reel R1. A similar mechanism (not shown for purposes of simplicity) is provided for rotating reel R1 in the counterclockwise direction while reel R2 is operated in a free-wheeling manner (when the ribbon has fully wound itself about reel R2).

The print head forms alphanumeric characters, symobls and/or graphic patterns and prints typically either five or nine dot columns in succession which collectively represent a character, numeral, symbol or graphic pattern. Carriage 28 rides along the rod-shaped guide tracks 43 and 44 which maintain carriage 28 and hence the print head 27 in the proper position as it moves in both the forward and reverse directions.

The registration or accurate placement of each dot column is assured by a registration assembly including a photosensing device comprised of a light source and phototransistor assembly (to be more fully described) which cooperates with a registration strip 45 supported by suitable brackets and having first and second displaced arrays of vertically aligned transparent slits, as will be described in detail hereinbelow. The optical assembly is comprised of first and second light sources and first and second phototransistors positioned on opposite sides of the registration strip 45 to generate "video" pulses as each of the assemblies pass slits in the upper and lower arrays in the registration strip to permit printing of "full step" dot columns, as well as "half-step" dot columns respectively employed for $5 \times 7$ and $9 \times 7$ dot matrix characters. The optical assemblies and registration strip are further employed to positively accurately and continuously indicate both the position of the print head and the direction of movement of the print head at every given instant of time.

The operation of the printer mechanism is such that on start up of the machine, a PRIME signal is generated which initializes all of the circuitry and generates a return-to-left (RTL) signal which causes the motor to be activated and the clutch to be disengaged to return the print head 27 to the left-hand margin of the paper document. The printer is now ready to accept data from either the keyboard or an external source such as, for example, a communications link or a computer.

Data is inserted in the form of binary words of at least 6 binary bits capable of representing up to 64 binary coded combinations which may, for example, represent the 26 letters of the alphabet, numeric characters 0–9, punctuation marks and other symbols, as well as function and control codes. The binary words representative of characters or other symbols to be printed are inserted into an input buffer to be initially examined for the presence of certain function codes. Thereafter, each word is inserted into an input holding register or latch on a word-by-word basis. Words transferred to the input latch are then transferred into a recirculate data memory which comprises a 133 stage recirculating shift register wherein each stage is capable of storing 8 binary bits. The words are shifted through the data memory and upon reaching the output stage, words are transferred into an output holding register or latch on a word-by-word basis. Each word transferred into the output latch is examined for the presence of all remaining function codes not decoded on the input latch. The function codes control printer operations such as carriage return, elongated characters from, feed, tab, etc. If the code word is a data word the output latch contents is applied to a character generator which sequentially develops dot column patterns at its output representative of the five (or nine) dot columns representing a character to be printed. These signals are applied to solenoid drivers for selectively energizing the solenoids S of print head 27 to successively print each dot column. The character generator is further controlled by the registration assembly which applies advancing signals to the character generator to successively cause the generation of each of the five (or nine) dot column patterns at the character generator outputs. The registration assembly also controls the precise moment of energization of the solenoids S so that the dot columns printed upon the paper document are in accurate registration at precise positions along the line being printed upon the paper document.

During the time that a character is being printed, the next character to be printed is shifted into the output stage of the recriculating data memory. During the space interval between characters, the next character is loaded into the output holding register and then printed. This operation continues until eiter a carriage return code is detected at the output register or the last character position for the line of print is reached or the buffer contains no more characters.

If a carriage return code is detected or the last character position on the line (i.e. right-hand margin) is reached, the print head returns to the left margin by disengagement of the forward clutch enabling carriage 28 by the spring to the left-hand margin. At this time an automatic line feed is performed in readiness for printing the next line. The only time that the print head is positioned to the left of the next print position is before the first character in a line is printed.

If the output buffer is empty before a carriage return code is detected or before the print head reaches the right-hand margin of the paper document, the print head continues to move beyond the last printed character before stopping, at which time the head is brought to a halt by energization of the electromagnetic brake 34. The print head remains stationary until the next character is received in the output buffer. When that character is transferred to the output register, ready to be printed, the brake is released, allowing the print head to move to the left under control of the return spring. The registration assembly detects the reverse movement of the print head and as the print head moves past the next print position, the forward clutch is turned on to reverse the direction of movement of the print head. The acutal time at which the forward clutch is energized occurs at a time after the print head has moved past the next print position to be printed. The print head is then moved in the forward direction and begins acceleration so that as the head sweeps past the next print position it is moving at "print speed". The registration assembly detects the movement of the head past the next print position causing printing.

In the incremental mode (i.e., when the keyboard is coupled to the printer) after a character is transferred from memory to the output holding register, the memory is recirculated and aligned ready to accept additional data. The data memory remains so aligned until the output holding register is empty. At this time, data is circulated, the next character is loaded into the output holding register, and the memory is then realigned to accept more input data.

The printer operates in the same fashion when functioning in either the local or the remote mode. Thus, the printer will print either individual characters or a burst of characters, will move beyond the last character to be printed and be abruptly halted. One distinct advantage of this arrangement resides in the fact that the last character printed is always capable of being clearly observed by the operator. When the next character or burst of characters is received, the print head then is moved abruptly to the left by deenergization of the forward clutch means so as to be moved under control of the return spring. The registration assembly detects the position and direction of movement of the head and causes energization of the forward clutch as the head moves past the next print position, at which time the movement of the head is then reversed so as to be moving in the forward direction. The registration assembly detects the exact position at which the next character is to be printed whereupon printing occurs on the fly until the character word has been processed, at which time the head will then coast toward a stop and be abruptly halted by energization of the electromagnetic brake 34 again stopping at a position to the right of the last character to be printed. It is immaterial as to what position to the right of the next print position the head is halted due to the fact that the registration assembly accurately and precisely detects the print head position at all times. Similarly, it is immaterial as to how far the head moves to the left of the next print position before being reversed to move in the forward direction since the registration assembly accuractly detects the precise position of the print head and permits printing at precisely the next print position. However, as a practical matter the print head typically moves about two to five character widths to the left and 10 to 12 character widths to the right of the last printed character.

Figure 2:
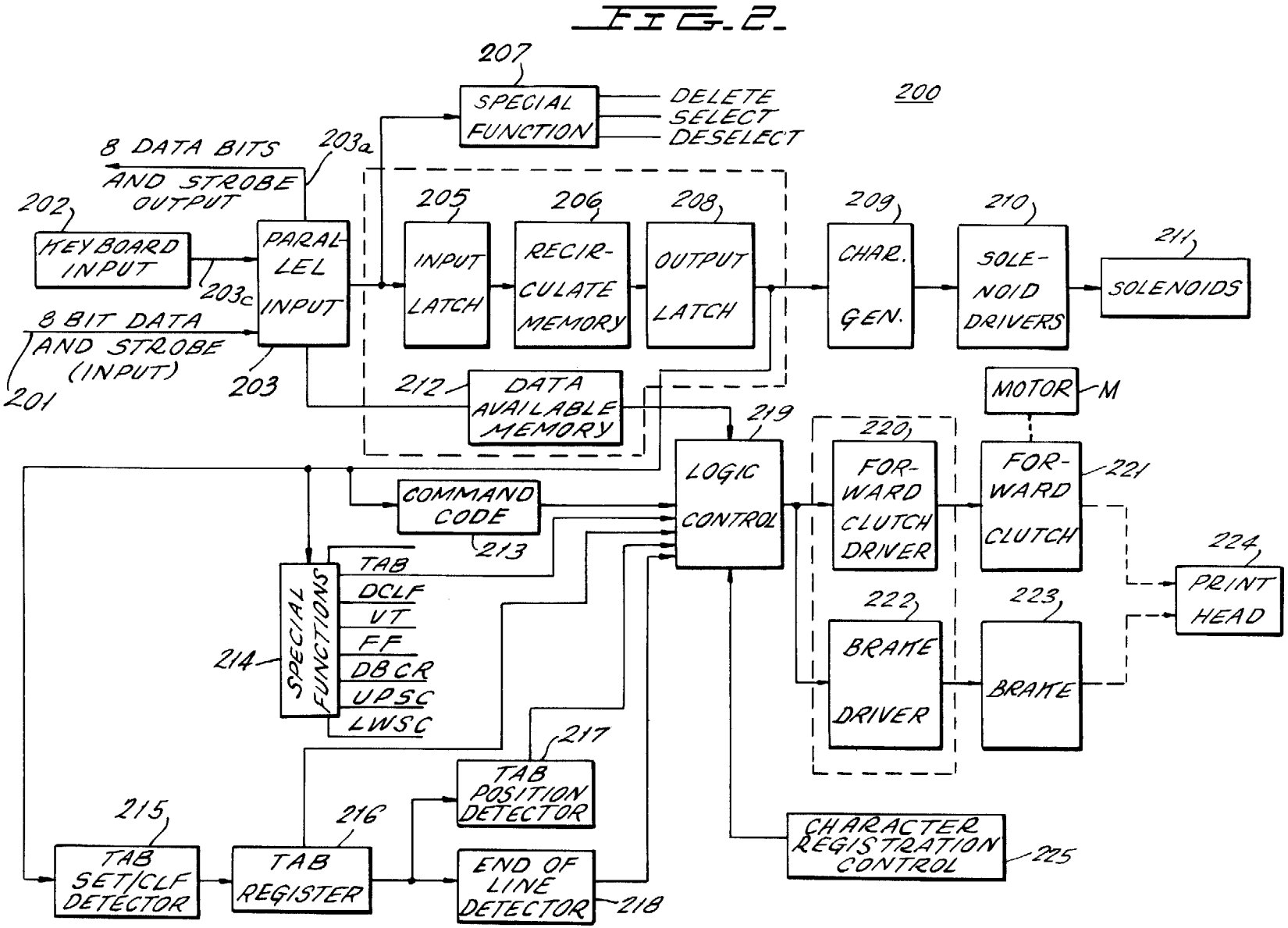

FIG. 2 shows a block diagram of the incremental printer electronics 200.

The printer is adapted to accept data from either a computer or communications link 201 or from a keyboard 202 which transfers data to the printer on a character-by-character basis. The print rate is of the order of 120 characters per second. A computer buffer 203 comprised of a parallel-input parallel-output register is adapted to receive code words in parallel fashion and ultimately transfer the code words to a larger internal recirculating memory 206 which is preferably of the MOS type and which is adapted to transmit information to a character generator 209.

The print control electronics controls the position of the print head 224 with feedback reference from an optical sensor physically mounted on the print head assembly and cooperating with a registration strip for providing accurate positional information.

A horizontal tab register 216 and associated circuitry allows the print head to slew at the 120 character per second rate to any predetermined position along the paper document to permit printing to begin at any position along a line.

The brake 223 is provided to allow the head to be halted at any position along the paper document. A return of the print head to the left-hand margin is accomplished by means of the aforementioned return spring. Forward clutch 221 serves as the means for coupling drive power to mechanically advance print head 224 toward the right-hand margin by selectively coupling motor M to the print head. If desired, the return spring can be replaced by a reverse clutch assembly, not shown for purposes of simplicity.

The registration means which is described in detail in copending application Ser. No. 476,581 filed June 5, 1974 and assigned to the assignee of the present application, utilizes an elongated registration strip shown therein in FIGS. **2*i* and 2*k* which cooperates with an optical assembly which comprises a detection head as shown in FIGS. 2*l*–2*o*** and which has two mechanical channels each physically displaced by an angle of 90° to obtain the positional information. Assuming 360° between the leading edge of one slot of one of the channels to the leading edge of the next adjacent slot (moving, for example, in the forward direction) the optical pick-ups of the detector are displaced by one-quarter that distance or 90°. The registration apparatus provides for absolute positional encoding in that if the print head is moved to the right, a count of the print head position will be incremented while if the print head is moved to the left, the count is respectively decremented so as to continuously provide information within the system electronics of the actual position of the print head at any given time.

All bits of the first code word, which may be either a command or data word, are loaded into the buffer 203 in parallel, at which time the word is examined by the special function logic 207 which examines the code word to determine whether it is a command word for performing either a delete, a select or a de-select operation, for example. The nature of the code word in buffer 203 also sets a predetermined character in a position in the data available memory 212 corresponding to a position in the recirculate memory 206. In the printer embodiment having a capability of printing 132 characters per line, the data available memory 212 consists of a 133 stage recirculating register having two bits per stage to provide indications for each of the 133 positions (117 data positions and 16 dummy character positions) so as to indicate the status of each position in the register as being:

No data in the data position; data in the data position; data in the dummy position; or no data in the dummy position.

The buffer 203 is comprised of a storage register having a number of stages sufficient to store all of the bits of one code word. Means are provided for selecting the code word inputted thereto from either the keyboard 202 or the computer input line 201. Switching logic is also provided for outputting keyboard code words inserted into the register 203 to the outside world to output lines **203*a*** which may couple the code words to either a communications link or a computer input.

The output of circuit 203 is simultaneously coupled to the data available memory 212, input latch 205 and special function circuitry 207.

The data word loaded into register 203 is examined to determine the presence or absence of a special function, i.e., select-on, select-off or delete, which codes are detected prior to transfer of the data word from parallel input 203 to input latch 205. The select-on code (which is 021 in octal form) is acted on when detected just prior to its transfer to the input holding register or latch 205. The delete code which is an octal 177 is detected just prior to the input holding register or latch to prohibit the reception of any additional data but is not acted upon until after it is detected in the output holding register or latch and empty shift register is detected. The select-off (deselect) code which is octal 023 is detected just prior to the input holding register or latch to prohibit the reception of any additional data, but is not acted upon until after it is detected in the output holding register or latch 208. The remainder of all command codes are loaded into memory and detected once they are transferred to the output holding register 208. If an unused command code, i.e., a code with data bits in bit positions 6 and 7 low, is loaded into memory, the output will recognize the code as such and ignore it.

The following constitutes the command codes of the printer:

Select-on (021) when detected, this code will select the printer in the same manner as the select/deselect switch on the front of the printer.

Select-off (023) — the detection of this code in the output holding register causes a de-select switch on the front of the printer.

Set Tab (code 033 followed by code 021) — the set tab function is recognized when an escape (ESC) code is followed by a DC1 code. The tab will be set in the shift register 216 and the print head will move forward one position when the set tab function is detected.

Clear Tab (code 033 followed by code 023) — a clear tab function is recognized when an escape code (ESC) is followed by a DC2 code. The tab will be cleared in shift register 216 and the print head will move forward one position when the clear tab function is detected. If an ESC code is followed by any code other than DC1, DC2 or ESC, the sequence will be zeroed.

Horizontal tab (011) — the detection of this code causes the printer to perform a horizontal tab function whereby the print head is advanced in the forward direction until it reaches the next electrical horizontal tab stop. The horizontal tab register will be cleared on power up but not on select.

Back Space (010) — upon detection of this code the printer will back space by one position.

Line Feed (012) — the detection of this code causes the printer to perform a line feed function. However, the print head is not moved at this time regardless of the position of the print head when a line feed code is received.

Vertical Tab (013) — the detection of this code causes the printer to perform a vertical tab function while the print head remains in its last position regardless of location.

Form Feed (014) — the detection of this code causes the printer to perform a form feed function without moving the print head.

The line feed, vertical tab and form feed command codes may be provided with an option for returning the print head to the left-hand margin of the paper document during the performance of the function, if desired.

Bell (007) — the detection of this code causes the printer to perform a bell function which is typically the generation of an audible alarm.

Elongated Character On (016) — the detection of this code causes the characters that follow the code to be printed in the elongated or double width format.

Elongated Character Off (017) — the detection of this code causes the printer to return to printing in the normal format, typically 5 × 7 or 7 × 9 dot matrix.

The elongated character on and character off codes can be transmitted in such a format as to have every other character elongated. A jumper option may be provided for data bit eight to control elongated characters, if desired. The elongated format always turns off after a line of data has been printed and the print head is returned to the left-hand margin.

Carriage Return (015) — the detection of this code causes the print head to return to the left-hand margin of the paper document. A jumper option may be provided whereby the presence of a carriage return code simultaneously causes a line feed operation.

Delete (177) — a jumper option may be provided to inhibit the delete code from performing any function when received. When jumpered in, the delete code will remain in the input holding register until the memory buffer is empty, causing the initiation of a prime function at that time. A separate jumper option can also be utilized to determine if a delete function may be utilized to prime the horizontal tab register.

During printing, the print head is stopped at a position which lies to the right of the last printed character and the brake 223 is utilized to hold the print head in this position. Due to the unique positioning apparatus employed, it is immaterial as to the exact location at which the print head is halted. When the next printable character is presented to holding register 208, the brake is released and the print head is moved to the left under control of the return spring until the positioning apparatus senses that the print head has passed the next print position, at which time the forward clutch is energized, the print head is accelerated and the character is printed on the fly as the print head passes over the next print position. When the print head prints the last character in a line of characters, it will then return the print head to the left-hand margin. The only time the head will be positioned to the left of the next print position is when the next print position is the first or number one position on a line of characters.

The printer has the following function codes:

Local/Remote mode — when the printer is in the local mode, the keyboard data is channeled directly into the printer. When the printer is in the remote mode, the keyboard data is transmitted to the outside world and the printer accepts data from an external source such as the computer or communications link.

Set One, Set Two. The key switch provided on the keyboard is utilized to determine the level of data bit eight enabling the operator to choose between one or two character sets in the printer such as, for example, a standard ASCII and German character sets.

Column Counter — The column counter indicates the next print position.

Paper Out — When a paper out condition is detected the printer de-selects; accepts and acknowledges additional data; will not print the remaining data that is in memory until the forms override switch is depressed; shows a buffer full condition and continues showing a buffer full condition until the machine is selected; and does not prime the system on select if the printer is de-selected by a paper out condition.

Paper Runaway — is defined as a continuous paper movement for a period greater than 5–10 seconds which is selectively adjustable. The presence of this condition is considered to be a hardware failure and therefore the system must be primed.

Ready Light — A lamp is provided on the keyboard which is illuminated when the keyboard is operational. When an interface is not available, the ready light reflects the select condition of the printer. When an interface is available, the ready light is on during the local mode and at any time that the interface is able to transmit data. The light is off when the printer is de-selected.

The printer has the capability of receiving data at a rate of up to 75,000 characters (i.e., data words) per second. The first character received is transferred from parallel input 203 to input latch 205 and then is inserted into shift register 206 which, in the 132 character per line embodiment, comprises a 133 stage recirculating register having a capability of storing eight bits per stage. The first character inserted into the shift register is rapidly shifted through the register until it reaches the output stage whereupon it is loaded into output latch 208 so that the printer can start printing. After this time, the machine will receive characters on a character-by-character basis. There is a delay from the very first character received of 133 microseconds before the next character can be received. Once that next character has been loaded the printer can then receive data at a rate of up to 75,000 characters per second. Every time a character is removed from the buffer to be printed there is a 133 microsecond maximum delay as the shift register (recirculate memory 206) is spun to present the data to output latch 208 which constitutes a single character buffer. The single character input latch 205 connected to the input of register 206 is provided to permit the receipt of one character. The system's structure is analogous to a teletypewriter in that the actual printing mechanism has only one input. In the local mode, i.e., where the computer input is disengaged, the only input to the printing mechanism is the keyboard. In a half-duplex mode, the keyboard and computer inputs are gated together and the printer responds to whatever is on the line. In a full duplex mode, which is also referred to as an Echo-Plex mode, the keyboard transmits to an output through line **203*a*** and the processor or device coupled thereto accepts this information back to the printing mechanism which is looking only at the computer input side. Data is accepted in a parallel mode on a character-by-character basis. However, the printer may be modified through the inclusion of a serial-to-parallel or parallel-to-serial converter which, for example, can accept the parallel output from the keyboard, convert the output into serial data and load an auxiliary magnetic tape. In the half-duplex mode, a serial-to-parallel conversion can then be utilized to load the actual print mechanism to monitor the data being loaded from the keyboard to the tape, thus providing a hard copy of inputted data.

Each data word is transferred from the output of memory 206 into output latch 208. If the word transferred to output latch 208 is a data word, the logic control circuit 219 controls the mechanical operation of the print head.

Logical control circuit 219 examines the data available memory 212 (whose contents is stepped in synchronism with the contents of register 206) to determine whether the word in output latch 208 is a data word. Assuming the word to be a data word, the print head, prior to printing would be positioned to the right of the position of the last character printed and will be held there by brake 223. When the character to be printed is loaded into output latch 208, brake 223 is released and a reversing mechanism such as, for example, the aforementioned spring means, rapidly moves the print head to the left. The registration means, which continuously monitors head position, detects the movement of the print head to the print position immediately to the left of the position at which the last character or symbol was printed causing the forward clutch 220 to be energized and to reverse the movement of the print head and cause the print head to move toward the right and across the position at which printing is to occur. The registration means enables the print head to print a character or burst of characters in sequential dot columns under control of the character generator 209 which converts the code word in output latch 208 into dot column patterns with only one of the dot column patterns to be printed appearing at the output of character generator 209 at each dot column position, which position is controlled by the registration means. The dot column pattern appearing at the output of character generator 209 energizes solenoid driver circuits 210 which activate solenoids 211 in a selective manner thereby printing none, all, or some intermediate number of dots in each dot column. The completion of five dot columns completes the printing of a character and the registration means 225 signals the logic control circuit 219 to indicate that, unless another data word is transferred to output latch 208, that the forward clutch 221 may be deenergized and brake 223 may be energized to bring the print head 224 to a halt. It should be noted that the print head coasts toward a stop until the brake 223 is applied.

When a select signal is decoded, a prime function is performed at which time 16 dummy characters are loaded into recirculate memory register 206. The data available memory 212 is a multi-stage register having a number of stages equal to the number of the recirculate memory register 206 and having the capability of storing 2 bits per stage. This provides a capability of storing any one of four combinations in each stage of the data available memory 212 wherein a binary code 00 in any stage indicates that data is present in a data position; 01 indicates data is present in a dummy character position; and wherein 11 indicates that a dummy character is present in a dummy character position. When the machine is first turned on, 16 dummy characters (binary code 11) and 117 blank data characters (binary code 00) are entered into memory 212. The printer is now ready to accept code words from either input line 201 or keyboard 202. Up to 117 characters may be accumulated, at which time a dummy character will be decoded in the next loading position.

A buffer full signal to the computer will then go high at this time. However, the printer can still accept 16 additional data words. The buffer full signal will not go low again until the printer transfers data out of the buffer so that only 97 data words remain in the buffer.

When the first character from either the keyboard or the computer is transferred into input buffer 203, it is loaded into the first 00 position in the buffer which causes this position to have its code changed to 10. As each data word is entered, a 10 code is loaded into every data position until the first dummy character position is detected, at which time the data word loaded into the first dummy character position causes a loading of the binary 01 code into data available memory 212. This code is detected as indicating that a data word is in a dummy character position. There are 16 of these positions that can receive data. If data is loaded into all 16 positions and no data has been extracted from the shift register, recirculate memory 206 will now have 133 data words.

The printer has a horizontal tab capability which employs a shift register 216 (see FIGS. 2 and 4) having a number of stages equal to the number of columns capable of being printed. A tab condition is loaded into the shift register by transmitting an escape code followed immediately by DC1 code. In order to load a clear tab code, an escape code is transmitted followed immediately by a DC2 character code. Whereas the DC1 and DC2 codes perform this operation, it should be understood that other codes could be used for initiating these functions.

The manner in which the tabs are set is as follows:

The space bar of the printer is depressed to move the print head over as many positions as is necessary to arrive at the point where the tab is to be set. Upon arrival at the appropriate location, the escape key is depressed again over the next set amount of spaces, at which point another DC1 code is transferred into the printer electronics. This process is continued as many times as required until all tabs are set. In operation the characters are entered through the keyboard until the tab operation is required, at which time the tab key is depressed or the print heads automatically move over to the next tab position at the slew rate. A computer can also set tabs in the same manner as described for the keyboard by loading an escape code in DC1 code during data transfer, which codes will be recognized as being the same as those generated by the keyboard.

In order to clear the tabs which have been set, it should be first pointed out that when the machine is powered up, a PRIME condition will clear all tabs previously set in the machine. A jumper option may be wired into the machine to permit the DELETE code or INPUT PRIME to perform the same tab clearing function, if desired.

The process employed to clear a tab condition through the communications link or the keyboard link is to space to the tab position that is to be cleared. In other words, if there were a tab in position 33, the space bar is depressed 33 times or alternatively is depressed to cause the print head to move over 33 spaces. Alternatively, the horizontal tab code key may be depressed. This operation is followed by pressing an escape code and DC2 code key to clear out the tab. This process is followed for any further tab resetting at any position simply by spacing to the position where the tab was set and then clearing at that spot. Clarification for clearing the tab positions may be performed by hitting the tab key and noting where the head stops.

Data from a computer or other remote control source is received in the form of an 8-bit code supplied to the input 203*b* of 203 together with a $\overline{\text{DATA STROBE}}$ input which constitutes the timing pulse. The printer keyboard has a conventional key set wherein each key, when depressed, generates an 8-bit code. The 8 bits are each respectively coupled to input 203*c*. The output designated REMTE is derived from the keyboard's local/remote switch to indicate whether data is being selected from the keyboard for insertion into the printer or alternatively selected from the computer for insertion into the printer.

The output of keyboard input 202 can be coupled to input 203 or output 203*a* but not simultaneously.

An input $\overline{\text{LOSTRB}}$ signal (load strobe from the keyboard) strobes code words coupled to the outside world.

The load strobe signal from the keyboard input 202 creates the multiplex input data strobe signal DSTA used to enter data words into the printer electronics.

A ready signal (RDY) at the keyboard 314 which illuminates lamp $L_1$ (on the keyboard printer) to provide a visual indication that the printer has been selected by either the computer or the operator and is primed ready for operation.

Figure 3A:
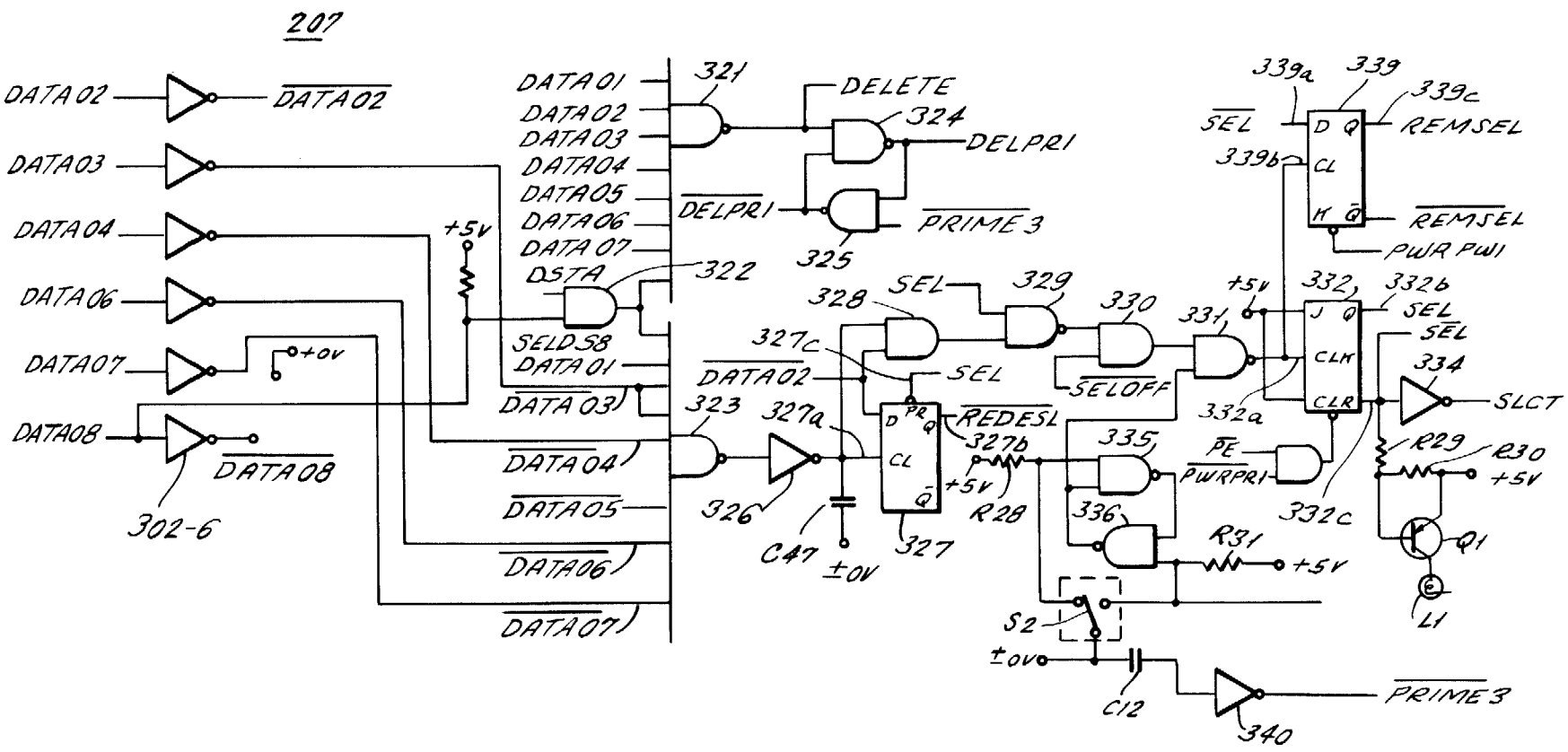

FIG. 3*a* shows the logic employed in the special functions circuitry 207 of FIG. 2 wherein the multiplex data appearing at selected outputs of latch 301 are simultaneously applied to inverters 320-1 through 320-6 and to gate 321. The data strobe signal DSTA is applied to gate 322 which detects the presence of a DELETE code to enable gates 321 and 323 when the data strobe signal and DATA01-DATA08 are all high. The output of gate 321 goes low in the presence of a DELETE code to cause the output of gate 324 to go high and thereby create the delete prime signal DELPRI. This high output is coupled to one input of gate 325 which is cross-coupled with gate 324 whose output develops the inverted signal $\overline{\text{DELPRI}}$. The output of gate 321 is also utilized as the DELETE signal which is utilized to delete any data which may have been previously shifted into the printer but not printed and, as an option, may be utilized to delete any tab settings, if desired.

Gates 323 and 328 detect receipt of a printer "select" code from the computer. The select condition is stored in bistable flip-flop 332 (by a high output 332b). A select may be generated by the keyboard switch S2 to similarly store the "select" signal SEL in flip-flop 332. The $\overline{Q}$ output 332*c* of flip-flop 332 illuminates the SELECT lamp L1 by energizing transistor $Q_1$. Flip-flop 339 sets its Q output 339c high when the keyboard select switch S2 is disconnected from gate 336 and when the $\overline{Q}$ output 332c of flip-flop 332 is high.

Figures 3B, 3C:
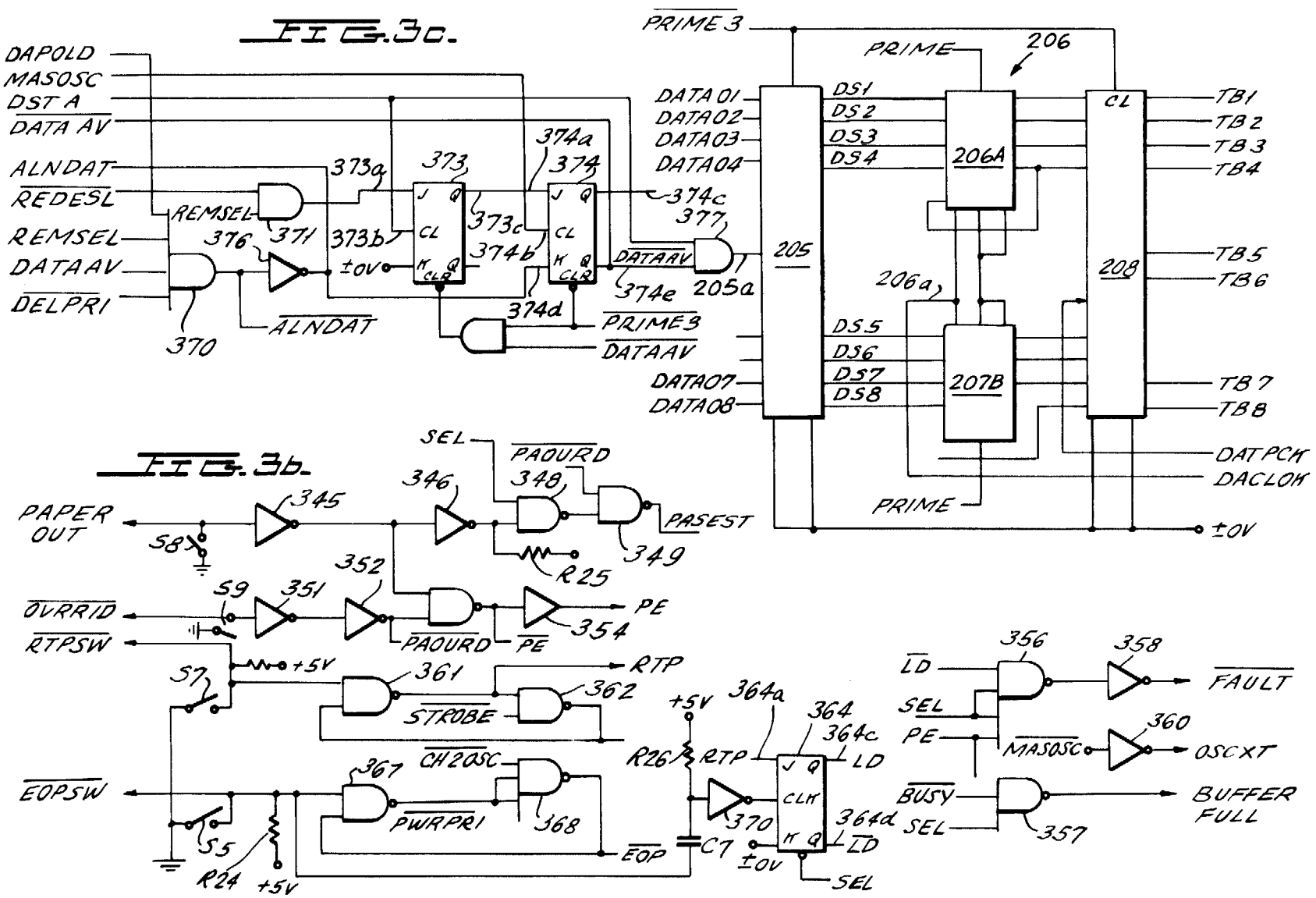

FIG. 3*b* shows the logical circuitry employed for creating special signals within the printer in connection with the status of the supply of paper provided to the printer and in connection with the location of the print head at the extreme left and right-hand margins of the paper document.

When the last sheet of the paper document passes over a paper out switch S8, the signal $\overline{\text{PAPEROUT}}$ goes low. This state is inverted at 345 to create the paper out signal PAOUTS, which is simultaneously coupled to inverter 346 and one input of gate 347. The output of inverter 346 is coupled to gate 348 whose remaining input receives the SEL signal. The output of gate 348 is coupled to one input of gate 349, whose remaining input receives the $\overline{\text{PAOURD}}$ signal (paper out override switch). Thus when the last sheet of papers run out of the machine and when the machine is in the select mode and when there is no paper override signal present, the output of gate 348 will be high and the output of gate 349 will be high to indicate a paper out (PASEST) condition.

When the override switch S9 provided at the control panel is depressed, the signal $\overline{\text{OVERRID}}$ will be low. This condition will be inverted at 351 and again inverted at 352 to develop the $\overline{\text{PAOURD}}$ signal, which is applied to one input of gate 349 and to one input of gate 347, whose other input receives the paper out signal PAOUTS. Thus the output of gate 347 will go low to create the signal $\overline{\text{PE}}$ in the presence of a paper out condition which is inverted at 354 to create the signal PE which is high when there is a paper out condition or, alternatively, which is low if the forms override switch is depressed or, alternatively, if paper is inserted in the machine. The signal $\overline{\text{PE}}$ is simultaneously applied to one input of each of the gates 356 and 357. The remaining inputs of gate 356 are coupled to receive the signal $\overline{\text{LE}}$ and $\overline{\text{SEL}}$. Thus, when a light detect (channel one video failure), when the printer has not been selected and when the printer has paper, all inputs to gate 356 will be high causing its output to go low. The condition is inverted at 358 to create the $\overline{\text{FAULT}}$ signal. If the machine is either in a light detect condition or in a deselect state or void of paper, at least one of the inputs of gate 356 will be low causing the output of gate 356 to go high and creating a low output at inverter 358 to indicate a fault condition.

The output of gate 357 will go high to create a BUFFER FULL signal whenever the machine is not selected or is busy or has no paper to create a BUFFER FULL condition.

The printer is provided with a ready-to-print switch S7 which is located adjacent the left-hand margin of the paper document. Switch cap S7 is a reed switch which cooperates with a permanent magnet member mounted on the print head carriage assembly and which is moved to the closed position when the printer carriage is adjacent the left-hand margin to provide a low input to gate 361 to cause its output to go high and thereby create the ready-to-print signal RTP, which is simultaneously coupled to one input of gate 362 and to one input of bistable flip-flop 364. The remaining input of gate 362 receives the $\overline{\text{STROBE}}$ signal so that gate 362 will go low to create the signal $\overline{\text{RTP}}$ and that which is low when both inputs to gate 362 are high. This low input is coupled to the remaining input of gate 361 to create a high RTP signal whenever either input to gate 361 is lower.

An end-of-print switch S5, which is preferably a reed switch, is positioned adjacent the right-hand margin of the paper document and cooperates with a permanent magnet member mounted upon the printer carriage assembly to close its switch arm whenever the printer carriage assembly is positioned adjacent the right-hand margin of the paper document to create the signal $\overline{\text{EOPSW}}$ which is coupled to one input of gate 367 whose other input is coupled to the output of gate 368. The remaining inputs of gate 368 are coupled to receive a video signal $\overline{\text{CH20SC}}$ from the timing fence and $\overline{\text{PWRPRI}}$ to create the end of print signal $\overline{\text{EOP}}$ which is utilized in a manner to be more fully described.

When switch S5 is closed, this low input is coupled through inverter 370 to the clock pulse input of bistable flip-flop 364, which receives the RTP signal at input 364*a*. When the printer carriage assembly is adjacent the left-hand margin, ready to print switch S7 is closed developing the signal RTP signal at the output of gate 361. Thus the RTP signal clocked into bistable flip-flop 364 to create a high output level at terminal 364*c*, which generates the signal LD indicating that the timing fence has malfunctioned. A complement of this signal ($\overline{LD}$) is simultaneously generated in output 364d. Gate 356 and inverter 358 develop a "fault" signal when any of the signals $\overline{LD}$, $\overline{SEL}$ or $\overline{PE}$ (paper empty) are low. Gate 357 develops a BUFFER FULL signal when $\overline{PE}$ or $\overline{SEL}$ or BUSY are low.

Figure 3E:
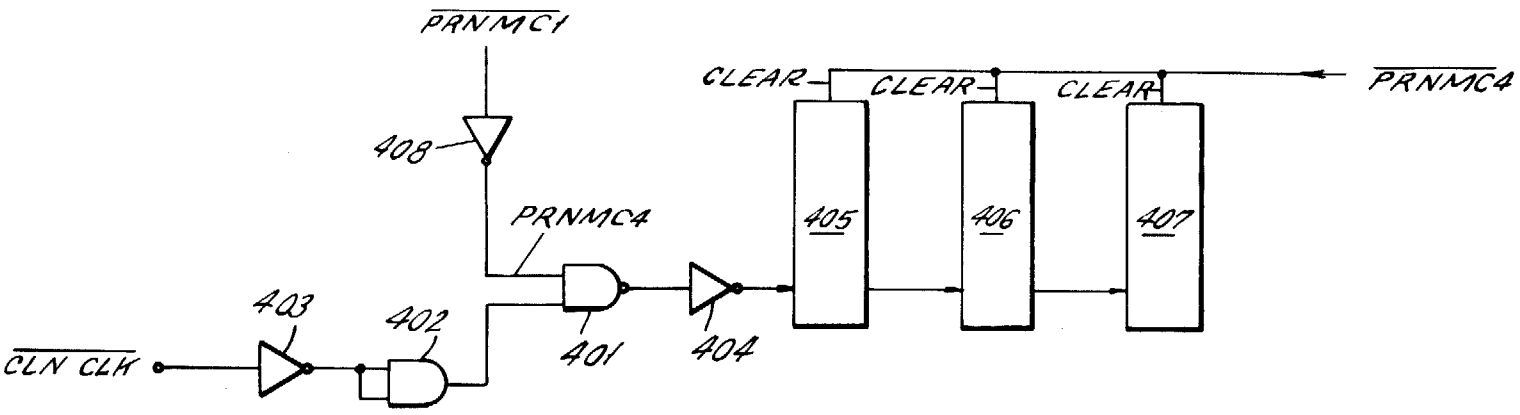
Figure 3D:
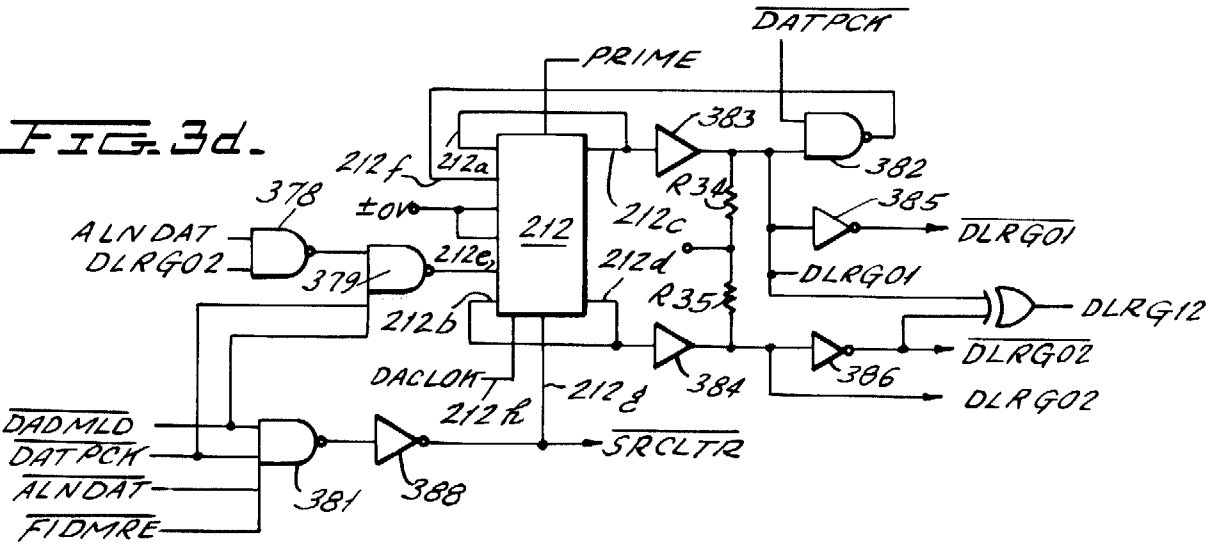
Figure 3E:
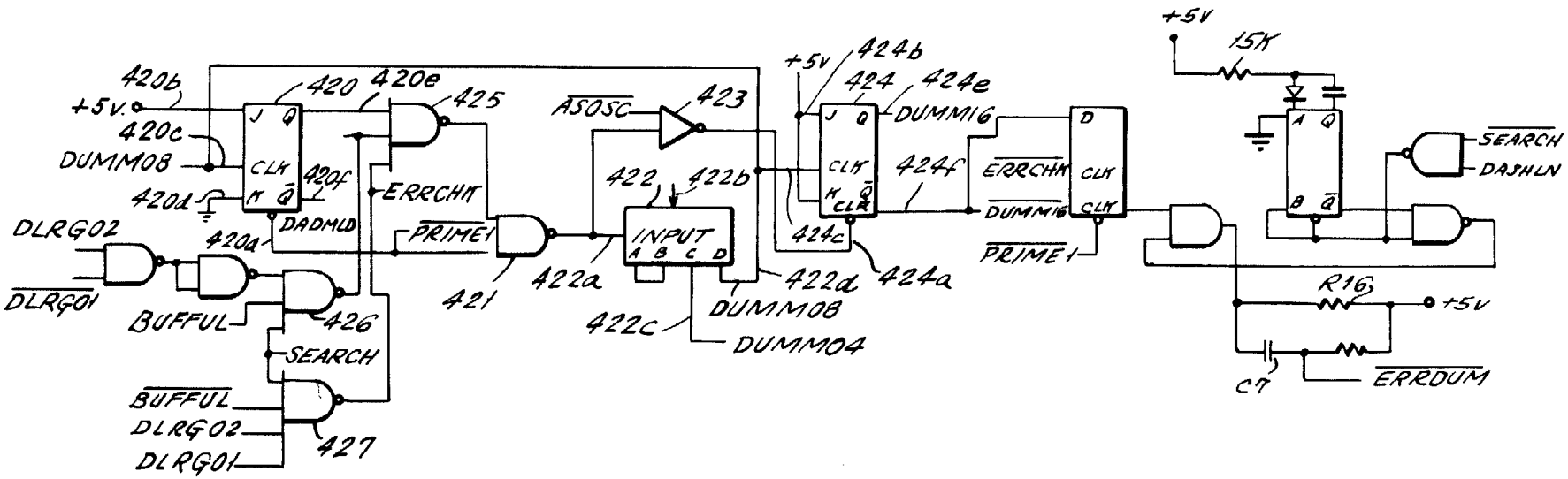

FIGS. 3*c* and 3*d* show the input latch 205, recirculate memory 206, output latch 208, data available memory 212 and control circuitry in greater detail. When the remember select (REMSEL) signal is high, indicating the printer has been selected, and when the signal $\overline{RE\text{-}DESL}$ is high, indicating the printer has not been deselected, the output of gate 371 will go high and this condition will be clocked into bistable flip-flop 373 upon the occurrence of the next data strobe signal DSTA (from the computer) to cause the output 373*c* to go high, thereby applying a high level to input 374a of bistable flip-flop 374. The signal DSTA derived from the computer or other remote source is the multiplex strobe signal not necessarily synchronized with the clock pulse source for the printer. The master clock pulse source is derived from the master oscillator of the printer which develops the master oscillator signal MASOSC which is applied to the clock input 374*b* of bistable flip-flop 374 to generate the data available signal DATAAV at output 374*c* of bistable flip-flop 374. $\overline{DATAAV}$ goes low causing gate 377 to apply a low signal to clock input 205*a* of latch 205 preventing the data word in register 203 (FIG. 2) from being loaded into latch 205.

Gate 370 receives the remote select signal, the data available signal (from 374*c*), and the delete prime complement signal and goes low when these signals are all high to generate the signal $\overline{ALNDAT}$ which is inverted at inverter 376 to create the signal ALNDAT. This signal is coupled to input 374*d* of bistable flip-flop 374 and is clocked in upon the occurrence of the next master oscillator pulse MASOSC to cause output 374*c* to go low and output 374*e* to go high. Upon the occurrence of the next high master oscillator pulse, the inputs of gate 377 will both be high, causing its output to go low. The output of gate 377 is coupled to the load input 205*a* of input latch 205, which is an 8-bit shift register receiving the multiplex data DATA01 through DATA08 from latch 301 shown in FIG. 3A. The outputs DS1 through DS8 of shift register 205 are coupled to the inputs of recirculate memory 206 which is comprised of a 133 stage recirculating shift register capable of storing 8 binary bits per stage. The clock input 206*a* of register 206 receives the data clock signal DACLOK to shift the binary word inputted to register 206 at the clocking rate and to continuously recirculate words in register 206 whenever the data clock pulses are being received and the signal $\overline{ALNDAT}$ is present.

All 8 bits of the output stage of register 206 are coupled to the 8 inputs of output latch 208 which is an 8 bit register adapted to have shifted therein to the data-words in the output stage of recirculating register 206 whenever the signal DATPCK is high, which signal is generated to transfer a data word from shift register 206 into output latch 208 and which is further utilized, as will be more fully described, to reload a dummy character into the associated stage of the data available memory 212 whenever a data word is outputted from recirculating register 206 into output latch 208.

The outputs TB1 through TB8 of output latch 208 are coupled to the character generator 209 (see FIG. 2), which operates in substantially the same fashion as is shown in FIG. 7 of application Ser. No. 476,581 filed June 5, 1974. A detailed description will be omitted herein for purposes of brevity.

The data available memory 212, FIG. 3*d*, is a 133 stage recirculating shift register capable of storing 2 binary bits per stage. Register 212 is recirculated at a rate synchronous with the shifting of the recirculate memory 206 (by the DACLOK signal). The 2 bits per stage of recirculate memory 206 serve to identify the nature of each 8 bit stage in each location of the recirculate memory 206. The code words stored in the data available memory 212 comprise the codes: 00 which indicates the presence of no data in a data position; 10 which indicates the presence of data in a data position; 01 which indicates the presence of data in a dummy position; and 11 which indicates no data in a dummy position.

Gate 378 has its inputs coupled to receive the signals ALNDAT and DLRG02. The signal ALNDAT as derived from the output of inverter 376 is high when the machine has been selected and data is available. DLRG02 is high when the associated output stage of register 212 is high. The output of gate 378 is coupled to one input of gate 379 whose remaining inputs receive the data dummy load signal $\overline{DADMLD}$ and the data pick signal $\overline{DATPCK}$. The output of gate 379 will go high when any of its inputs go low. Also gate 381 goes high when any of its inputs go low. Inverter 388 thus applies a low input to recirculate control input 212*g* to decouple outputs 212*c* and 212*d* from inputs 212*a* and 212*b*. When recirculate control input 212*g* is high the outputs at 212*c* and 212*d* are loaded into inputs 212*a* and 212*b*.

FIG. 3*e* shows the electronic circuitry for some of the displays available at the keyboard of the printer. When the signal PRNMC4 is high (indicating that the printer has returned to the left-hand margin) this causes one input of gate 401 to go high. The other input of gate 401 is coupled to the output of gate 402 which, in turn, is coupled to receive a clock column indicator signal $\overline{CLNCLK}$ through inverter 403. So long as signal PRNMC4 is high, the clock column indicator pulses are passed by gate 401 and inverter 404 to clock the illuminated digital display circuit 405 which is adapted to display any digital number from 0 through 9 to represent the units position. The output of display circuit 405 is coupled to the input of display circuit 407, display circuits 405, 406 and 407 representing the units, tens and hundreds readout to identify the column position of the printer head is located. When the signal $\overline{PRNMC1}$ is generated, this signal is passed by inverter 408 and gate 409 which is coupled into the clear inputs of display devices 405, 406, and 407 to clear the vinsual display whenever the print head carriage is returned to the left-hand margin.

The RDY signal described hereinabove is applied to one input of transistor Q2 to illuminate the ready lamp and indicate that the printer is ready for operation. The remote select switch REMTE is also provided at the keyboard location to locally select or deselect the printer.

FIG. 3*f* shows the circuitry employed for initializing the printer logic. The signal $\overline{PRIME1}$ which is derived from the PRIME signal is applied to the clear input 420*a* of bistable flip-flop 420, causing its outputs 420*f* and 420*e* to go high and low respectively. Output 420*e* is the $\overline{\text{DADMLD}}$ signal which is utilized when the system is being primed. The $\overline{\text{PRIME1}}$ signal is also applied to gate 421 whose output is coupled to the input 422*a* of a 4 bit binary counter 422 and which is simultaneously coupled through inverter 423 to the clear input 424*a* of bistable flip-flop 424. Gate 421 goes high upon the presence of a prime condition causing the output of inverter 423 to go low to apply a clear signal to the clear input of bistable flip-flop 424 causing its outputs 424*e* and 424*f* to go low and high respectively.

Initializing of the printer is performed as follows:

When the printer is initially turned on, a one-shot multivibrator (not shown for purposes of simplicity) is triggered by a capacitor charged by the power turned on to generate the signal PRIME1 and initialize the printer. This technique, for example, is shown in FIGS. 4–4*f*, 6 and 6*a* of copending application Ser. No. 476,581 filed June 5, 1974. The signal $\overline{\text{PRIME1}}$ is applied to the clear input 420*a* of bistable flip-flop 420 (FIG. 3*f*) causing its outputs 420*e* and 420*f* to go low and high respectively. After the printer electronics is initialized $\overline{\text{PRIME1}}$ goes high. The output 420*e* being low causes output of gate 425 to go high. The high states applied to gate 421 causes this output to go low removing a clear condition from input 422*a* of 4-bit binary counter 422. Simultaneously therewith the low output of gate 421 is inverted at 423 to apply a high level signal to the clear input 424*a* of bistable flip-flop 424 leaving its outputs 424*e* and 424*f* low and high, respectively. Immediately upon the removal of the clear signal from four-bit binary counter 422, the master oscillator signal $\overline{\text{MASOSC}}$ applied to input 422*b* enables four-bit binary counter 422 to accumulate pulses. At a count of 8 output 422*d* identified as DUMMO8 is applied to the clock input 420*c* of bistable flip-flop 420, as well as to the clock input 424*c* of bistable flip-flop 424. The square pulse developed at output 422*d* of the 4-bit binary counter is shown adjacent clock input 420*c* and can be seen to go high as soon as the eighth pulse from the master oscillator is applied to the counter and remains high for eight additional pulses for a total of 16 pulses, at which time the output level goes low to clock in the high level at input 420*b* of bistable flip-flop 420 which then causes outputs 420*e* and 420*f* of the bistable flip-flop 420 to go high and low respectively. The high level at 420*e* causes gate 425 to go low to prevent any more master oscillator pulses from clocking 4-bit binary counter 422. The trailing edge of the DUMMO8 signal clocks in the high level applied to input 424*b* of bistable flip-flop 424 to cause its outputs 424*e* and 424*f* to go high and low respectively, which indicates that a total of 16 master oscillator pulses have been counted.

Figure 1B:
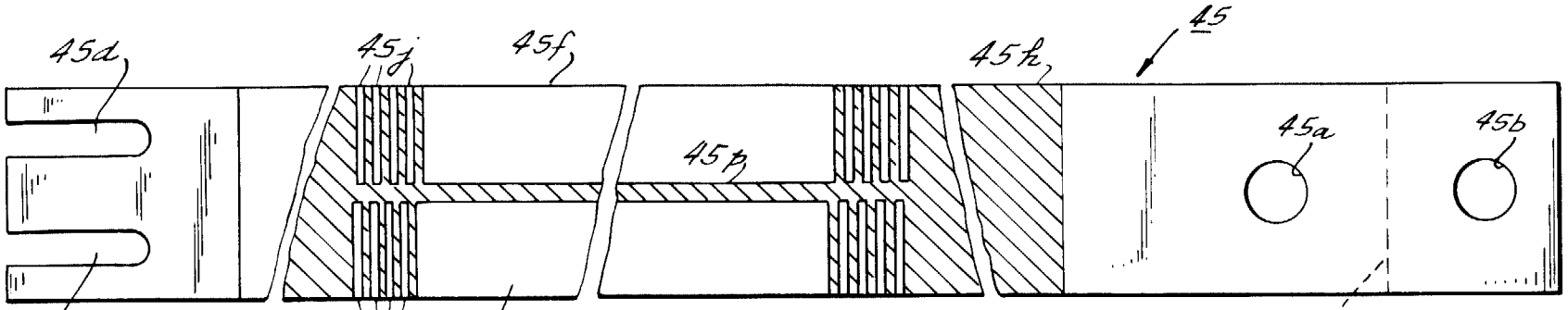
Figure 1C:
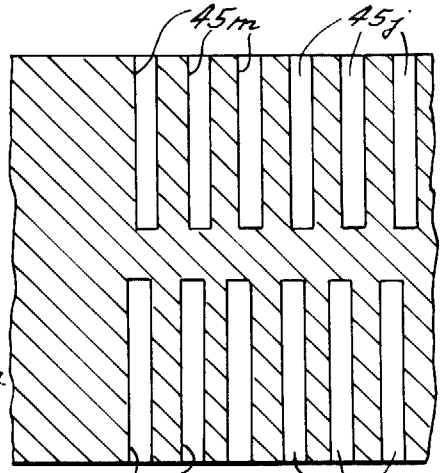
Figure 1D:
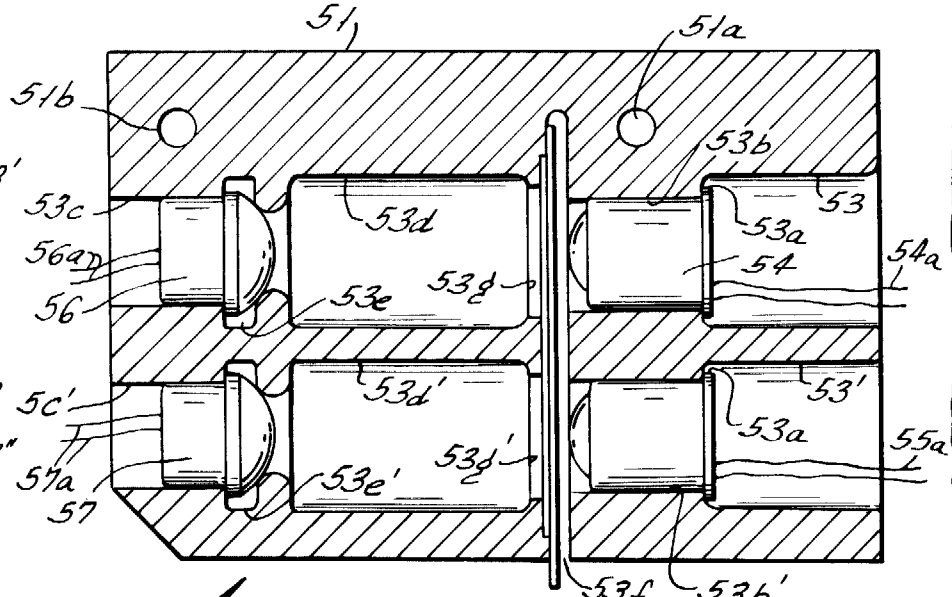

As soon as the output 420*e* (i.e., the signal $\overline{\text{DADMLD}}$) is caused to go low, this low input is simultaneously applied to gates 379 and 381 shown in FIG. 1*D*, causing the outputs of gates 379 and 381 to go high thereby loading a binary one into the input stage of the data available memory 212. The high output of gate 381 is inverted at 388 to develop the shift register recirculate control signal ($\overline{\text{SRCLTR}}$) which is applied to the recirculate control input 212*g* to prevent the binary states appearing at outputs 212*c* and 212*d* from being fed back to the input stage and to simultaneously permit external data to be loaded into the data available memory. Thus binary ones are loaded into data available memory at its input 212*e* upon the occurrence of the gated master oscillator clock pulse identified by signal DACLOK applied to the clocking input 212*h* of the data available memory. The loading operation continues for 16 consecutive clock pulses to load binary ones into input 212*e* of the data available memory. Input 212*f* of the data available memory receives a binary one level from the output of gate 382 since its input receiving the output of gate 383 will be low during the loading of dummy characters. Thus a binary 11 code will be loaded into the first 16 stages of data available memory 212 which binary 11 code is identified as the presence of a dummy character in the dummy position. The receipt of the 16 master oscillator pulses by 4-bit binary counter 422 (see FIG. 3*f*) sets bistable flip-flop 420 to cause the signal $\overline{\text{DADMLD}}$ to go high upon completion of the loading of the dummy characters into the data available memory 212. The trailing edge of the $\overline{\text{DADMLD}}$ signal provides the acknowledgment signal to indicate that the printer is now ready to accept either character or function codes from either the keyboard or the computer sources.

The acknowledgment signal enables either the keyboard or the computer or other source to load characters into the printer. The signal RAMSEL described previously in connection with FIG. 3*b* causes the output of gate 371 to be clocked into bistable flip-flop 373 and causing the high level developed at output 373c to be clocked into bistable flip-flop 374. The low level of the signal $\overline{\text{DATAAV}}$ enables gate 377 to step the first character into input latch register 205. The low level of signal $\overline{\text{ALNDAT}}$ developed at the output of gate 370 is also applied to gate 381 to remove the recirculate control level from recirculate input 212*g* of data available memory 212 and thereby enable data to be into the data available memory 212. The output of gate 379 will be low at this time to input the binary word 10 indicating that data is being loaded into a data position.

REGISTRATION SYSTEM

As was described in connection with FIG. 1*a*, elongated registration strip 45 is mounted between a pair of support brackets 48 (only one of which can be seen in FIG. 1*a*) which brackets are secured to the front end of the printer frame. The registration strip is substantially parallel to the printing surface of the paper document. In a printer having a capability of printing 132 5×7 matrix characters wherein each character consists of five dot columns plus a space between each character there are of the order of 792 dot column positions across each line of print. Thus, the registration strip is provided with 396 slits. For a printer having a capability of printing 10 characers per inch with six dot column positions per character (i.e. five dot columns per character plus a space between adjacent characters) the registration strip is thus provided with 30 transparent slits per inch with the center line distance between slits being of the order of 0.0334 inches. The width of each slit is preferably of the order of 0.016 inches measured in the direction of travel of the print head.

The registration strip 45 is shown in detail in FIG. 1*b* and is comprised of an elongated plastic member having a thickness typically of the order of 0.007 inches. The plastic material may, for example, be MYLAR, a registered trademark identifying a particular type of plastic. The registration strip has a substantially rectangular configuration and one end is provided with a pair of openings 45*a* and 45*b*. To mount the registration strip upon a printer frame, an end portion thereof is folded along line 45*c* so as to align openings 45*a* and 45*b*. The holes are secured to one bracket of the printer provided with a fastening member to pass through aligned openings 45*a* and 45*b*.

The opposite end of registration strip 45 is provided with a pair of elongated open-ended slots 45*d* and 45*e* which are secured to one of the remaining brackets wherein the depth of the slots is sufficient to enable the registration strip to be stretched between the pair of mounting brackets so as to be reasonably taut.

The intermediate portion of the registration strip is provided with upper and lower arrays 45*f* and 45*g* respectively. The intermediate portion of the registration strip is coated with an opaque material 45*h*. The arrays 45*f* and 45*g* are each comprised of a plurality of transparent slits 45*j* and 45*k* spaced apart by the opaque material and which, as can best be seen from FIG. 1*c*, are uniformly spaced along the registration strip and are of uniform width. However, it can be seen that the slits in the upper array are staggered relative to the lower array so that their left-hand edges 45*m* each lie a uniform spaced distance to the right of the forward or left-hand edges 45*n* of the lower array 45*g*. The upper and lower arrays are separated from one another by an elongated horizontally aligned continuous opaque section 45*p* to prevent any spillover of light between the upper and lower optical assemblies.

Figure 1E:
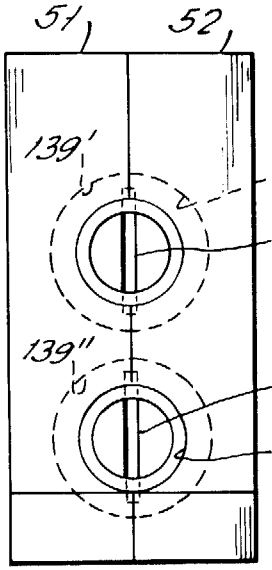

FIGS. 1*d* and 1*e* show a dual slit optical assembly 50 utilized with the registration strip 45 and which is comprised of a pair of optical assemblies mounted within a housing 50 having two molded portions 51 and 52. FIG. 1*d* shows the interior of the housing portion 51. Since the interiors of both housing portions are substantially mirror images of one another, only the interior of housing portion 51 will be described, for purposes of simplicity.

The molded housing portion 51 is provided with a pair of threaded openings 51*a* and 51*b* for receiving suitable fastening means to secure the housing halves 51 and 52, it being understood that the housing half 52 is provided with similar openings. The right-hand portion of housing 51 is provided with a pair of elongated hollow cylindrical openings 53 and 53' communicating with the right-hand edge of the housing. The inner end of these hollow openings terminate at shoulders 53*a* and 53*a'* which extend between openings 53, 53' and short cylindrical hollow portions 53*b* and 53*b'*. Light emitting diodes 54, 55 are positioned in hollow openings 53*b* and 53*b'* so that their base portions, which are provided with outwardly directed flanges, rest against shoulders 53*a* and 53*a'*. Leads 54*a* and 55*a* serve as a means for connecting the light emitting diodes to an energy source. Openings 53 and 53' may be filled with an epoxy to seal the housing.

The hollow portions 53*b* and 53*b'* communicate with the hollow slots 53*c* extending in the vertical direction and having a thickness sufficient to permit registration strip 45 to substantially freely pass therethrough.

The left-hand end of housing 51 is provided with a pair of hollow cylindrical bores 53*c* and 53*c'* communicating with the left-hand side of housing 51. The cylindrical bores each open into a hollow cylindrical bore 53*d* and 53*d'*, respectively, which bores are of substantially enlarged diameter, there being a pair of shoulders for positioning and receiving photodetectors 56 and 57 whose enlarged diameter portions rest between the aforesaid shoulders and within the openings 53*e* and 53*e'*. The leads 56*a* and 57*a* of the photodetectors extend through bores 53*c* and 53*c'* to facilitate a connection to appropriate circuitry. The light emitting diodes and photodetectors may be epoxied or otherwise cemented into position.

Chambers 53*d* and 53*d'* communicate with the vertically aligned slot 53*f* through narrow vertically aligned "half-slits" 53*g* and 53*g'* which, together with similar half-slits in housing half 52 cooperatively form the narrow slits 58 and 59 shown best in FIG. 1e. The width of these slits are of the order of 0.006 to 0.008 inches.

The manner of operation is such that the light emitting diodes 54 and 55 are continuously illuminated so as to direct light into vertical slot 53*f*. Housing 50 is mounted to the underside of carriage 28 with the clearance slit 53*f* being arranged to permit the passage of stationary registration strip 45 therethrough as the carriage 28 and hence the housing 50 is moved. Light passes through each of the slits 45*j* and 45*k* (FIG. 1*b*) of the registration strip and enters into the hollow openings 53*d* and 53*d'* so as to impinge upon the photodetectors 56 and 57 when the slits 45*j* and 45*k* move into alignment with the slits 58 and 59 provided at the right-hand end of hollow openings 53*d* and 53*d'*. These signals are utilized to both accurately control the location of each dot column to be printed as well as providing novel means for detecting the position and direction of movement of the print head.

Figure 2A:
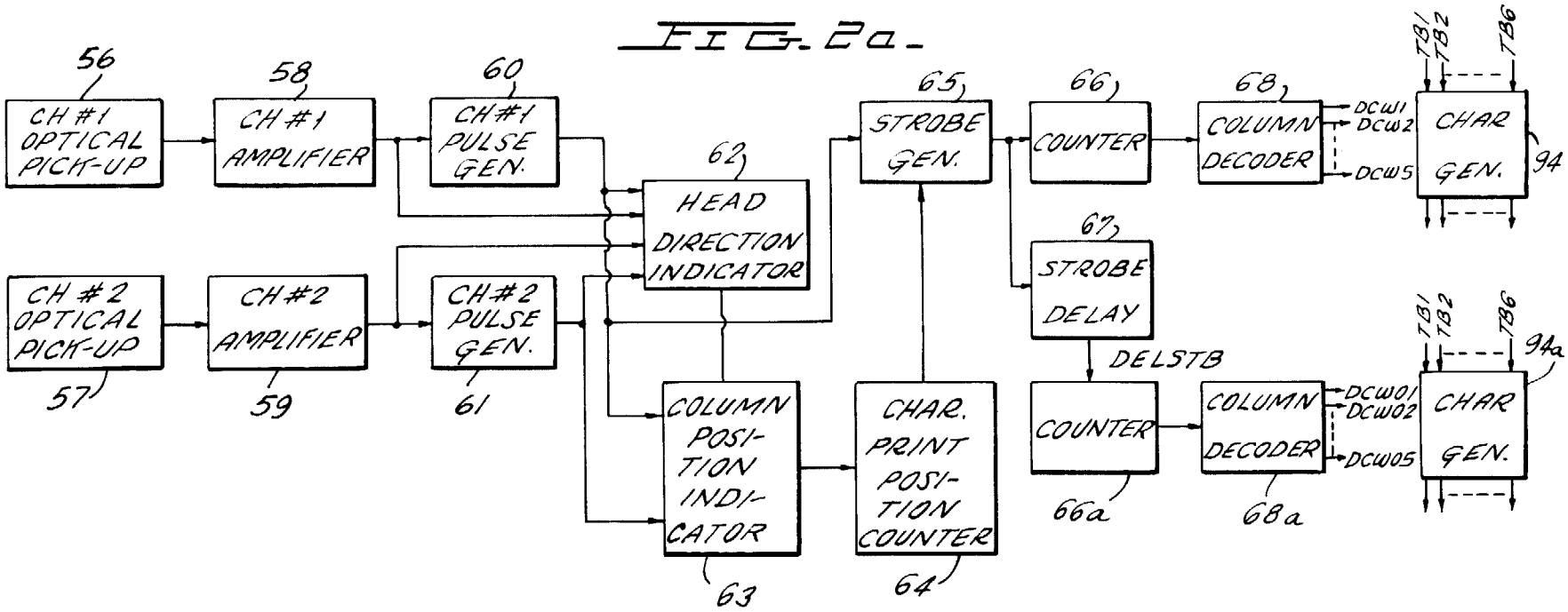
Figure 2B:
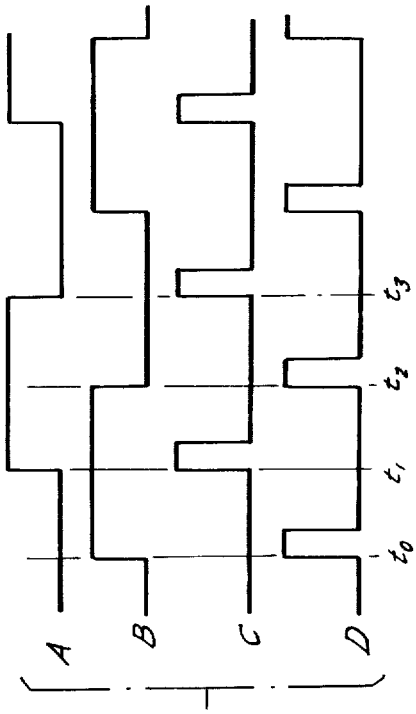

FIG. 2*a* shows the absolute position decoder circuitry in block diagram form and FIG. 2*b* shows a plurality of waveforms useful in describing the novel operation. Waveform A represents a series of square pulses generated by present day registration apparatus. Thus, at time $T_1$ the pulse output goes high to indicate the light source and cooperating photodetector are passing a slit in the registration strip. At time $T_3$ the output drops abruptly to indicate that the light source and cooperating photodetector have passed over an opaque portion of the array positioned between a pair of slits. Succeeding square wave pulses of waveform A represent a passage of the light source and photodetector along the registration strip.

The waveforms A and B (FIG. 2*b*) represent the output of the photodetectors S for each array. The output of each photodetector 56 and 57 (shown in FIG. 2A) is passed through appropriate amplifier means 58 and 59 and pulse generator means 60 and 61 to generate narrow square pulses at the leading and trailing edges of each square pulse of waveforms A and B, which narrow pulses (waveforms C and D) are utilized to enable the firing of the print head solenoids. The leading edge of each square pulse can be seen to occur at the leading edge of each slit, as shown by waveforms A–D.

Waveforms A and B represent the outputs of the upper and lower photodetectors 56 and 57 respectively. Considering the registration slit pattern and assuming that the optical assembly is moving from the left to the right, waveform B can be seen to form a positive going square pulse at time $t_o$. One-quarter cycle thereafter or, after a 90° phase lag, the upper photodetector starts to pass the leading edge of the next following registration slit which is indicated by waveform A so that at time $t_1$ the leading edge of a positive going pulse is initiated.

Moving in the reverse direction, it can be seen that at time $t_2$ the trailing edge of waveform B which leads the trailing edge of waveform A (at $t_3$) when moving forward, now becomes the leading edge which follows the leading edge ($t_3$) of waveform A occurring at time $t_2$ by a 90° phase lag. Thus, regardless of the direction of movement of the print head, the same timing and geometric relationships are maintained. Waveform C shows the solenoid actuating pules developed by the pulse generator 60, while waveform D shows the pulses developed by the pulse generator 61. These pulses are utilized in the electronic circuitry of FIG. 2*a* to be described hereinbelow for the dual purpose of controlling the accurate and precise firing of the solenoid print heads when moving in the print direction and providing unique circuitry for determining at any given instant the direction of travel of the print head, as well as the exact position of the print head. Only one set of narrow square pulses as shown by waveforms C and D are utilized for strobing the print head solenoids. However, both sets of narrow square pulses are used for determining the direction of movement of the print head.

The head direction indicator circuit 62 accepts signals representing the past, present and future position of the head to determine whether the head is moving in the forward or reverse direction. The head direction indicator will not accept two subsequent pulses from the same channel unless it has received one pulse from the other channel. The column position counter circuit 63 accepts the forward or reverse information from the head direction indicator circuit 62, as well as deriving the pulses from generators 60 and 61 for the purpose of incrementing or decrementing the counter respectively with either channel 1 or channel 2 pulses (depending upon the direction of movement). The column position indicator counter 63 counts in steps of 6. That is, it counts six transparent slits in one direction and then zeros itself, at which time it clocks the character print position counter 64. The output of the column position indicator counter 63 is utilized to increment or decrement the count in character print position counter 64 only when the head is not printing. When the head moves in the forward direction, the column position indicator 63 will count to +5 before it zeros itself and clocks the character print position counter in the direction of head motion. In the reverse direction, counter 63 counts to 11 and then resets itself. When the printer is printing a character, the character print position counter output is blocked to provide a unique count for the print position. The counter 64 counts either up or down from a zero reading to maintain a count representing the displacement of the print head from the next print position. When the head is moving and the count of counter 64 reaches zero, printing is initiated. The strobe generator 65 is enabled when the zero count is reached with the head moving in the forward direction and is disabled once the character is printed if the memory is void of data. The output of strobe generator 65 is applied to counter 66 and to strobe delay circuit 67 whose output is employed in conunction with the strobe circuit 65 in the printing of 9×7 dot matrix characters. The strobe generator 65 develops pulses under control of pulse generator 60 to step counter 66. The output of counter 66 is applied to column decoder 68. Decoder 68 controls the dot column developed at the output of the character generator.

The photodetectors have their outputs amplified at 58 and 59 to provide signals of sufficient strength. The leading edges of these signals trigger pulse generators 60 and 61 for the purpose of providing the narrow square pulses at both the leading and trailing edges of the video pulses shown in waveforms C and D.

Figures 2B, 2C:
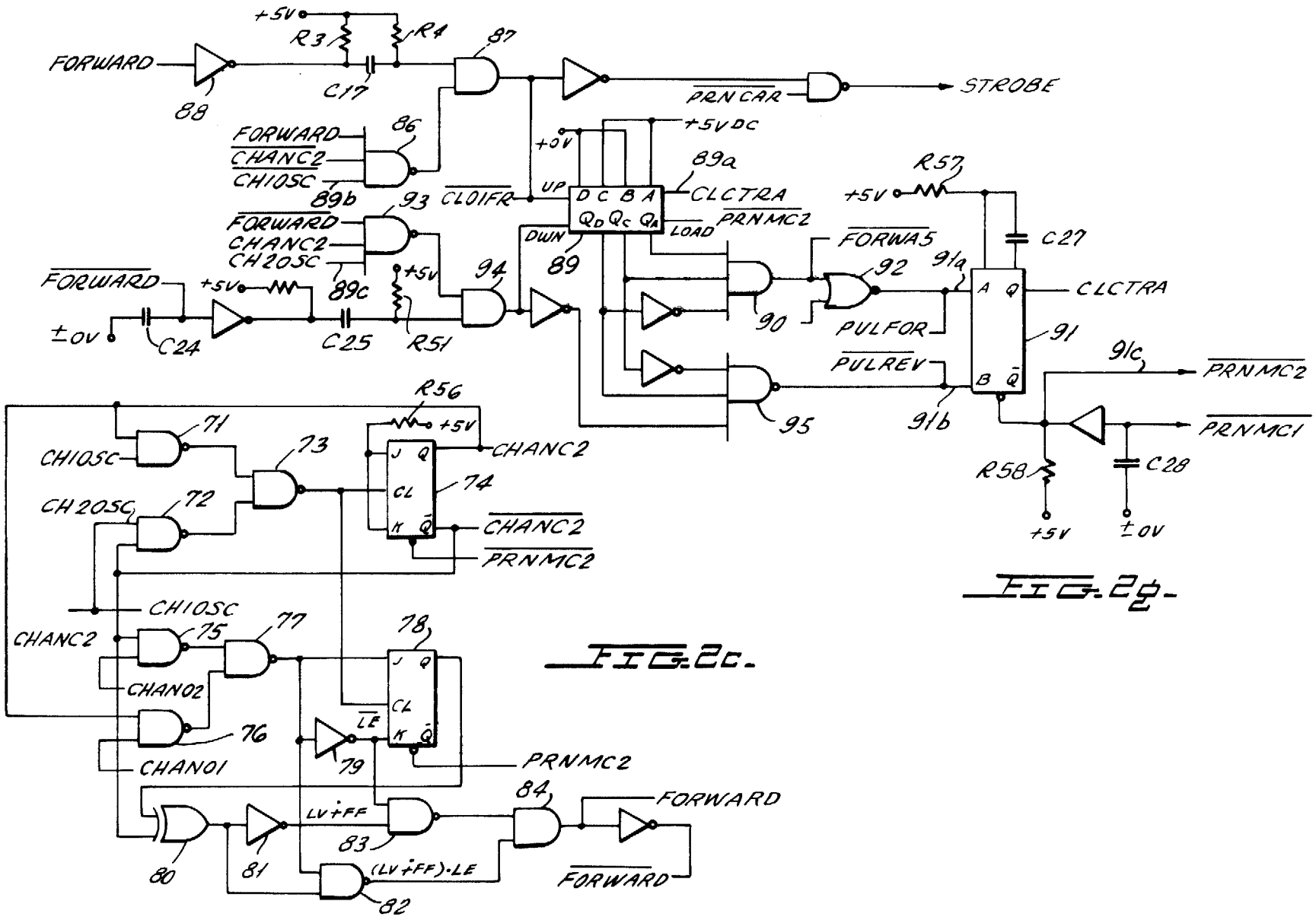
Figure 2E:
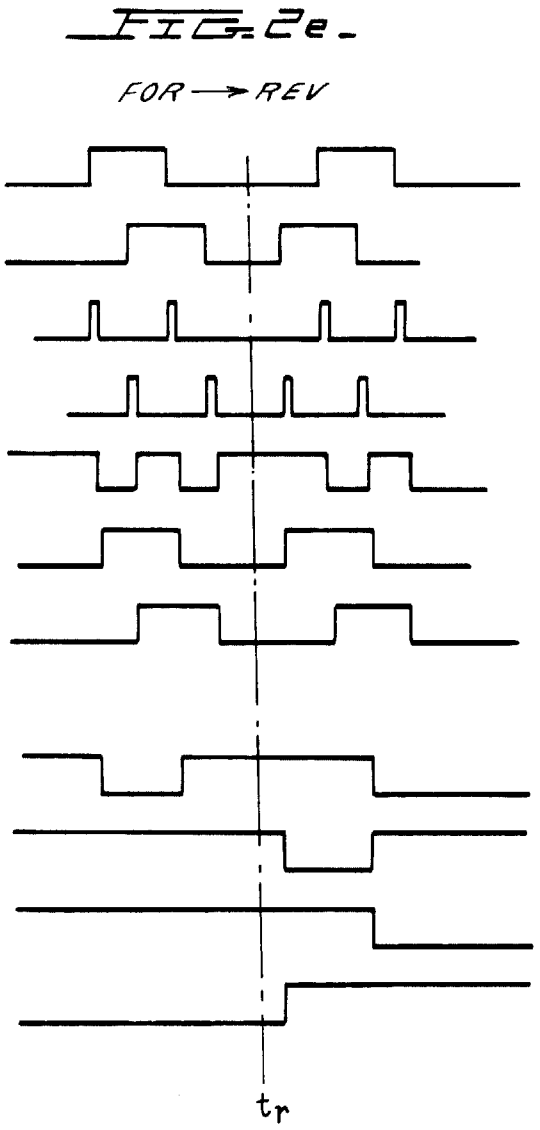
Figure 2D:
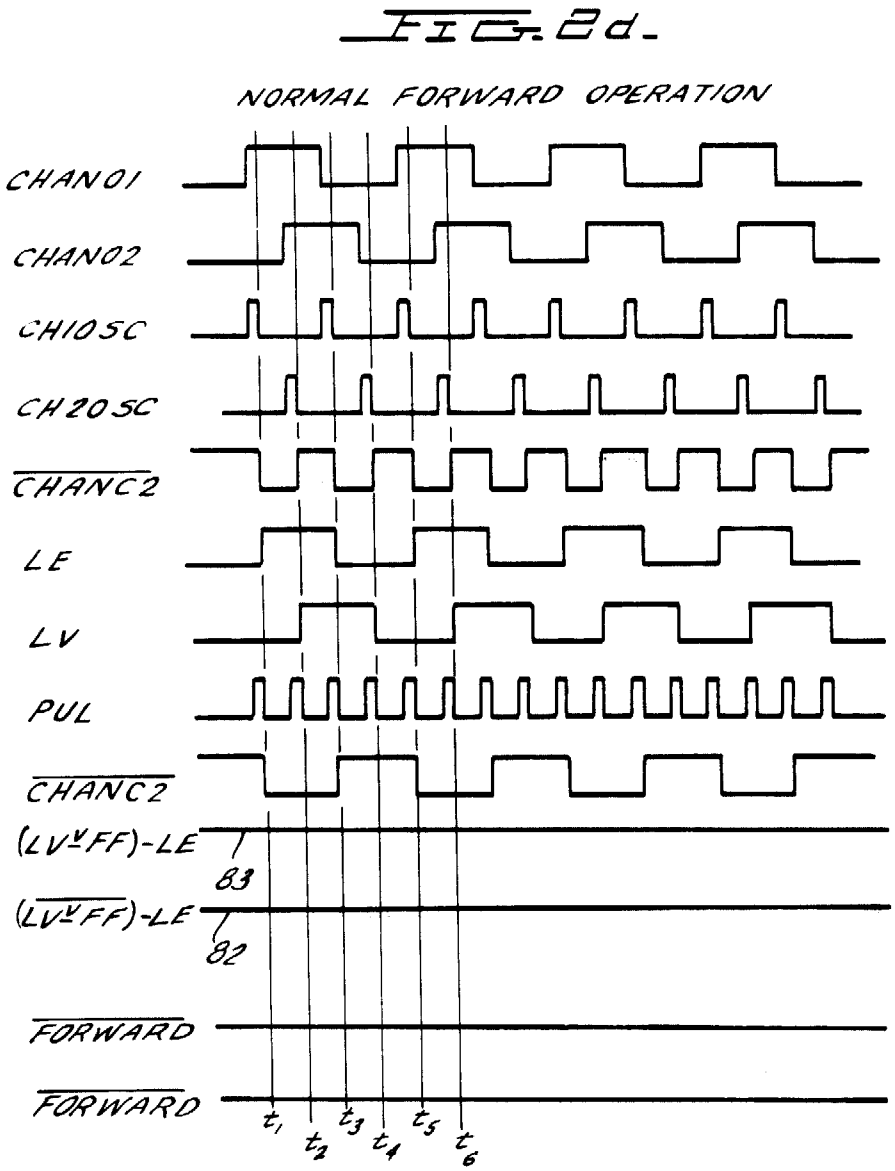
Figure 2F:
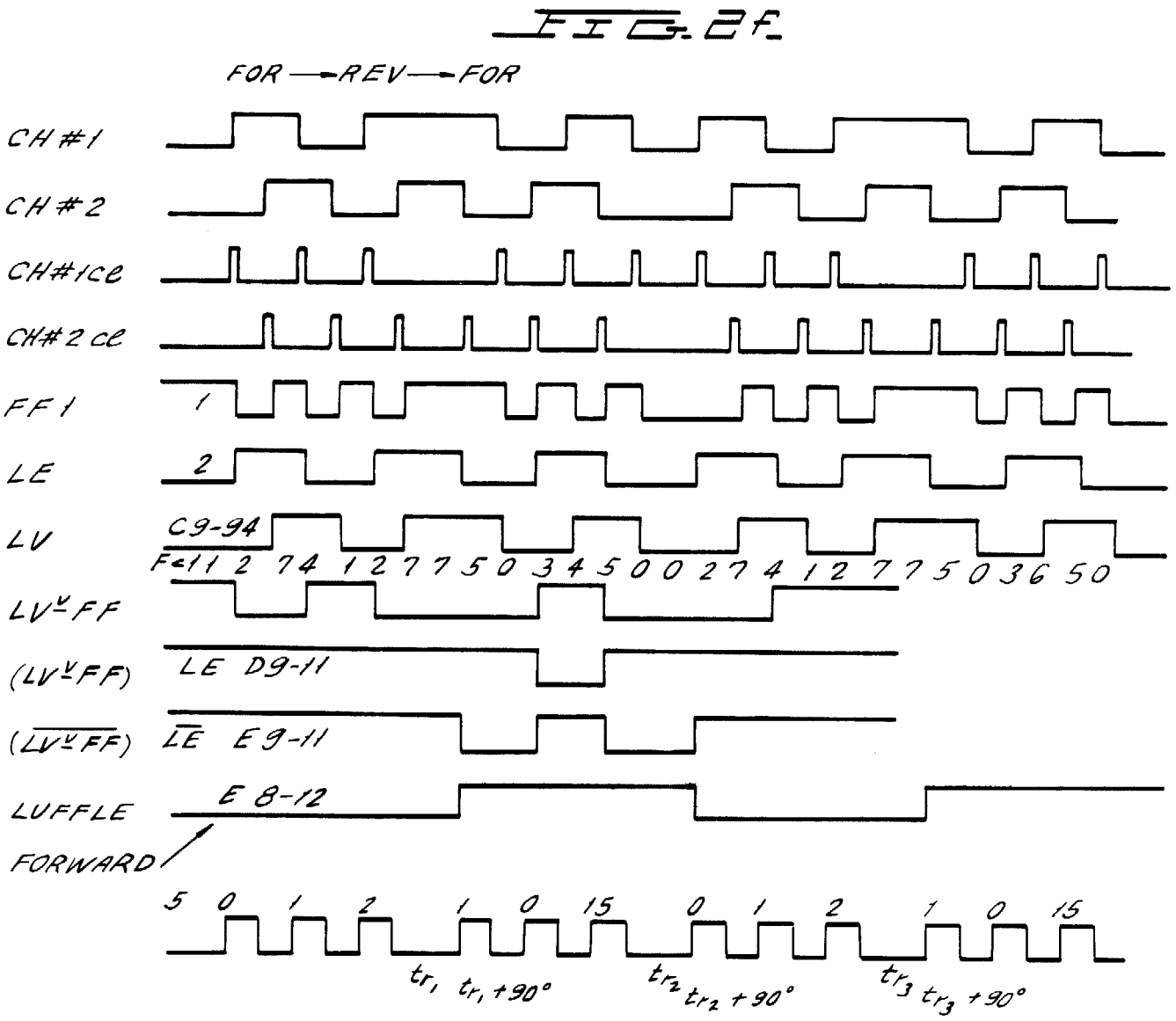

FIG. 2*c* shows the circuitry of the head direction indicator 62 of FIG. 2*a*, while FIGS. 2*d*–2*f* show waveforms useful in explaining its operation. The waveforms CHANO1 and CHANO2 of FIGS. 2*d*–2*f* are substantially identical to the waveforms A and B shown in FIG. 2*b* and thereby represent the outputs of the photodetector devices for the first and second video channels. These square waves are applied to the pulse generators so as to form narrow pulses at both the leading and trailing edges of each square wave as represented by the waveforms CH10SC and CH20SC, respectively. For example, the leading and trailing edges of waveform CHAN01 which occur at times $t_0$ and $t_2$ (waveform B-FIG 2*b*) generate the CH10SCpulses occurring at $t_0$ and $t_2$ (waveform D-FIG. 2*b*).

As shown in FIG. 2*c* inputs CH10SC and CH20SC are applied to respective inputs of the gates 71 and 72, the remaining inputs of these gates being coupled respectively to the Q and $\overline{Q}$ outputs of bistable flip-flop 74. The outputs of gates 71 and 72 are coupled to respective inputs of gate 73 whose output is coupled to the clocking input CL of flip-flop 74 and flip-flop 78. The signal $\overline{PRNMC2}$ is generated when the print head has been reset to the left margin making the Q and $\overline{Q}$ outputs low and high respectively, these outputs being represented by the signal titles CHANC2 and $\overline{CHANC2}$ respectively. From the waveform $\overline{CHANC2}$ of FIG. 2*d*, it can be seen that the Q output is flipped at the trailing edge of each and every one of the CH10SC and CH20SC pulses occurring, for example, at $t_1 + t_2 +$ during the first two transitions of the $\overline{Q}$ output. Also FF 74 does not change state unless each CH10SC pulse is followed by a CH20SC pulse. The output of gate 73 is thus the summation of the CH10SC and CH20SC pulses and is represented by the waveform PUL. These pulses are employed to clock both of the flip-flops 74 and 78.

Gates 75 and 76 perform logical ANDING operations on the Q and $\overline{Q}$ outputs of bistable flip-flop 74 with the video inputs CHAN01 and CHAN02 respectively. The results of these AND operations further undergo logical AND operation by gate 77 to develop the signal LE shown in FIG. 2d, which signal is inverted at inverter 79 with the true and complement form serving as the J and K inputs of flip-flop 78. Waveform LV shows the Q output of flip-flop 78. The signal LV and the signal $\overline{CHANC2}$ are applied to EXCLUSIVE-OR gate 80 which develops a high output only when one of its inputs is high and which develops a low output when both of its inputs are low. This output is simultaneously applied to one input of gate 82 and to inverter 81 which inverts this condition. The signal LE is applied in true and inverted form to the remaining inputs of gates 82 and 83 respectively. The outputs of gates 82 and 83, shown by the waveforms 83 and 82 of FIG. 2*d*, which may be represented by the Boolean algebra expressions $(\overline{LV + FF})\cdot(LE)$ and $(LV + FF)\cdot(LE)$. From a consideration of these signals it can be seen that inputs to gate 82 and gate 83 are never simultaneously high so long as the print head continues to move in the forward direction. Thus, the outputs of these gates will both be continuously high causing the output of gate 84 to be high to develop a high FORWARD signal whose complement $\overline{FORWARD}$ is developed by inverter 85 and this waveform is shown in FIG. 2*d* to be low whenever the head is travelling in the forward direction. The waveforms of FIG. 2*e* represent the case where the head is initially moving in the forward direction and then is reversed so that the channel 2 video pulses represented by waveform CHAN02, lead the channel 1 video pulses, i.e. waveform CHAN01. It can thus be seen that two consecutive CH20SC pulses occur without the occurrence of a CH10SC pulse therebetween so as to fail to cause a transition in the $\overline{\text{CHANC2}}$ waveform as shown at time $t_r$. This detection leads to a reversal in the $\overline{\text{FORWARD}}$ direction. The waveforms of FIG. 2*f* show the typical occurrence of the print head being moved in the forward direction, stopped when no further data words are to be printed, and then reversed upon receipt of subsequent data words after at least a momentary delay so as to move the head in the reverse direction to pass the next print position and then being reversed again to be moved in the forward direction so as to be able to print on the fly. The omitted pulses from the waveforms CH10SC occurring at time $t_{r1}$ and $t_{r3}$ and the omitted CH20SC pulse occurring at time $t_{r2}$ cause the next succeeding pulse of the other channel to cause reversal in the forward waveform as shown at times $t_{r1}$ +90°; $t_{r2}$ +90°; and $t_{r3}$ +90° respectively.

The direction indication signal from circuit 62 is applied to the column position indicator 63 which is an up/down 4-bit binary counter which is incremented by CH10SC pulses when the head is moving in the forward direction and which is decremented by CH20SC pulses when the head is moving in the reverse direction. FIG. 2*g* shows the column position indicator 63 in greater detail wherein FORWARD, $\overline{\text{CHANC2}}$ and CH10SC pulses are applied to gate 86. The output of gate 86 is coupled to gate 87, together with the FORWARD signal which is inverted at 88. Counter 89 is an up/down counter and is automatically set at its clear input 89*a* to a count of zero and may count either up or down from this count. Assuming that counter 89 has just been reset and that the print head is moving in the forward direction, the Chiosc pulses applied at input 89*b* increment counter 89. A decoder 90 decodes the presence of a count of 5 to develop a forward pulse signal PULFOR indicating the completion of one character count (i.e. completion of five dot columns) and triggering one-shot multivibrator 91 through gate 92 to develop an output pulse at 91*c* to substantially instantaneously reset counter 89. When the head is moving in the reverse direction, channel 2 oscillator pulses CH20SC decrement counter 89 at down input 89*c* from a count of zero through gates 93 and 94 and decoder 95 detects the presence of a count of 11 in counter 89 to develop a pulse reverse signal $\overline{\text{PULREV}}$ which also triggers one-shot multivibrator 91 to reset counter 89 so as to beginning to count down from zero so long as the head is moving in the reverse direction.

Character print position counter 64 which is shown in greater detail in FIG. 2*g* is a four-stage up/down counter having a capability of counting to ± 16 and adapted to initiate a printing operation only at the zero count of the counter.

Each character is comprised of six columns (i.e. five dot columns plus a blank space). Since the first column on every character is always a blank, this time is employed to determine if additional data is in memory or printing. If additional data is present, it is loaded in the output holding register and the head continues its forward motion. If at the end of this character there is no longer data in the shift register the electronics waits until the first column is complete. At the end of this time the next video column pulse will turn off the forward clutch and turn on the brake. The video pulses detected for each character which is not printed will increment the up/down counter 89. In the case where the head is moving forward decoder gate 92 (FIG. 2*g*) generates a forward pulse signal PULFOR at the occurrence of each blank condition. These pulses are passed by gate 96 only if the output of gate 97 is high. The output of gate 97 will be high if there is no carry from character position counter 64 ($\overline{\text{PCARRY}}$) or when the head is not printing $\overline{\text{PRNBLK}}$. Assuming that the printer has printed the last character and examination of the output holding register indicates that there is no character to be printed, then the $\overline{\text{PRNBLK}}$ signal will go low causing the output of gate 94 to go high thereby enabling gate 96 to pass forward pulses PULFOR (one for each character position). As long as no backspace pules ($\overline{\text{BSPULS}}$) occur at this time, gate 96 is enabled and the counter 64 starts to count upward from zero, counting on a character level. The detection of the fact that printing has stopped causes the forward clutch to be disengaged and the brake to be engaged, halting the head at some position to the right of the last printed character. The number of character positions to the right to which the head has moved is accumulated by counter 64.

As soon as the next character code is delivered to the output holding register, the electromagnetic brake is released causing the head to move to the left under control of the return spring. This operation causes the development of output pulses from decoder 95 (signal $\overline{\text{PULREV}}$) which are applied to the down input of counter 64 causing the counter to count down. As soon as the counter reaches a zero count (indicating that the print head is moving over the next print position in the reverse direction) the forward clutch is engaged. However, until actual engagement occurs the head will move to the left of the next printing position and in the count down condition develops a $\overline{\text{BORROW}}$ signal which serves to energize the forward clutch and thereby terminate incremental counting of the counter. The energization of the forward clutch reverses direction of movement of the print head causing again the development of PULFOR pulses which, so long as the counter 64 has not reached a zero count and so long as the counter is not printing, counter 64 starts to count up from a count of less than zero toward zero. As soon as counter 64 has counted to zero, the signal $\overline{\text{PCARRY}}$ is developed and serves to initiate printing. This signal, together with the signal $\overline{\text{PRNBLK}}$, causes the output of gate 97 to go low preventing any foward pulses PULFOR from being passed through gate 96 to the up input 64*b* of counter 64 as long as printing continues whether it be for a single character or a burst of characters.

As soon as register 64 develops a zero count the output of gate 97 goes low (FIG. 2*g*). This signal is inverted at 98 causing gate 99 to develop the signal $\overline{\text{PRNCAR}}$ when the clutch is engaged (FORCLU). The signal $\overline{\text{PRNCAR}}$ enables strobe generator 65 (FIG. 2*a*) which is pulsed by the channel 1 oscillator pulses CH10SC. These pulses are applied to counter 66 which, together with decoder 68, serve to develop the five stepping signals DCW1–DCW5 employed for selecting the appropriate dot column position for the character whose code appears in the output holding register 208 (FIG. 2) and which is applied to the inputs TB1–TB6 of character generator circuit CGI. By delaying the output of strobe generator 65 through delay neans 67, a strobe delay signal DELSTB is developed for incrementing counter 66*a* which, together with dot column decoder 68*a*, serves in the same manner as the counter 66 to dot column decoder 68 for the purpose of stepping dot column patterns out of character generator CG2 which, combined with the dot column patterns stepped out of character generator CGI produces 9×7 dot matrix characters.

Figure 4A:
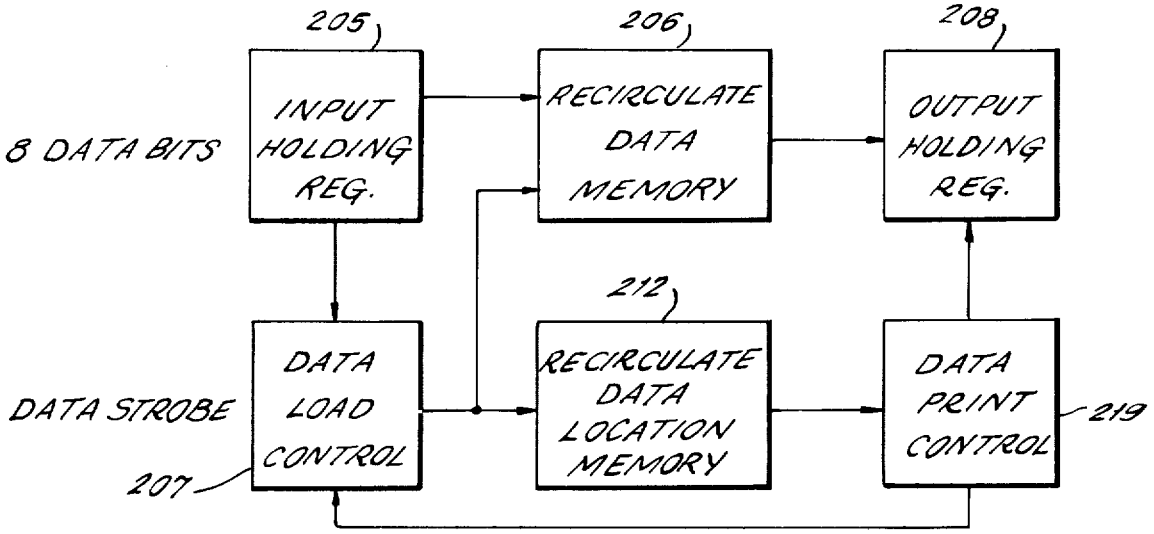
Figure 4:
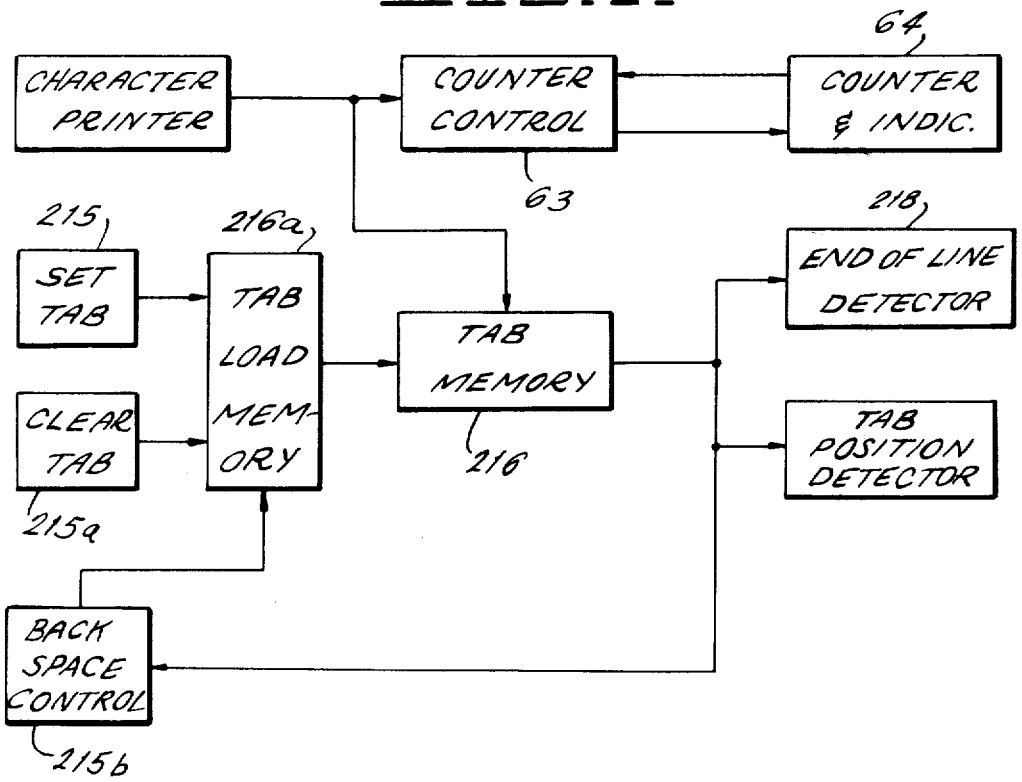

FIGS. 2 and 4 show the horizontal tab capability of the printer. When the printer is initialized, the PRIME signal loads an end of line code (binary 11) into the first position in the tab memory register 216 which comprises 80 or 132 stages respectively, each capable of storing two binary bits. This code, when detected at the output (i.e. right-hand stage of the tab memory register by end-of-line detector 218, automatically turns the printer electromagnetic brake and forward clutch off to return the print head to the left-hand margin under control of the return spring. The receipt of a "set tab" code from either the remote facility of the keyboard is transferred through buffer 203, input latch 205, memory 206 and output latch 208. Detector 215 detects this code and loads a tab condition (binary 01) into recirculating register 216. A "clear tab" code (binary 00) is loaded into the tab memory in the same fashion. The loading of a horizontal tab in a particular position is obtained by depressing the keyboard space bar as many times as is necessary to get to the point where the tab is to be set. The register 216 is continually advanced at this time by video pulses from the registration assembly. The tab set key is then depressed to place the binary 01 code into the proper two-bit stage of tab register 216. This operation is continued as many times as is necessary to set the appropriate number of horizontal tabs.

Thereafter, the characters desired to be printed are entered into the recirculating memory 206. The TAB button of the memory keyboard is then depressed causing the head to move at the slew (i.e. high speed) rate. Whereas the description given hereinabove indicates that tabs may be set by the printer keyboard, it should be noted that a computer or other remote facility can set tabs in the same manner wherein a horizontal tab code loaded during data transfer would be recognized the same as the horizontal tab key on the keyboard.

The tab operation is initiated when the special function decoder 214 detects a horizontal tab code in the output holding register 208. The logic control 219 energizes the forward clutch driver 220 and the forward clutch 221 causing the print head to move at the slew rate. At this time tab register 216 is recirculated by the PULFOR signal (as each character interval is counted) until the first tab position is detected by detector 217, at which time the forward clutch is disengaged and after a brief delay (provided by suitable delay means) so as to thereafter abruptly bring the print head to a halt. As soon as the tab position is detected, the character counter is incremented in a positive direction from zero to develop a count representing the number of character positions to the right of the tab position at which the print head has stopped. The forward clutch is disengaged as is the brake, the head moves to the left through the next printing position until a borrow pulse is developed and the head is then moved to the right by energization of the forward clutch to print the next character on the fly at the horizontal tab position. During these operations the next character word is loaded into the output holding register in readiness for the printing operation. As each horizontal tab code is received the print head moves to the next tab position (at the slew rate) in a similar manner. If no tabs have been set and a horizontal tab code is recognized in the output holding register, the print head advances to the end of the print line. Detector 218 detects the end of line position code. At this time the tab function is satisfied and the head returns to the left-hand margin under control of detector 218 and logic control circuit 219 and rests over the left-hand limit switch. Register 216 is continually shifted by video pulses so that its output stage always corresponds with the actual position of the print head.

FIG. 4*a* shows the storage capability in simplified block diagram form wherein the recirculate data memory 206 has the capability of storing 133 data words which may consist of command codes as well as printable characters. When data is received it is transferred to the input holding register. At this time the load control 207 checks to insure that the data memory is lined up and ready to accept additional data and that the input data is not a delete code, a select code or a deselect code. When all of these conditions are satisfied, the data load control 207 loads the data word into data memory 206 as well as loading data available and position information into the data location memory 212. The data print control circuit 219 detects the presence of data in memory and will circulate the data memory 206 until the data word is picked off and loaded into the output holding register and the shift register is aligned and ready to accept additional information. During this time the data location memory register 212 is also circulated and when the data is extracted from data memory 206, the data available and position information is extracted from the data location memory 212. The data location memory is a dual 133-bit shift register providing the four aforementioned codes for keeping track of data in memory which constitutes no data in data position; data in data position; data in dummy position; and dummy in dummy position to provide an indication of where data is at all times and enables the system to detect an overfilled condition in the data memory shift register 206. When the printer is initially primed, the prime control inserts 16 dummy characters into data location memory 212, which dummy characters permit detection of a condition in which the data memory is filled up to 117 characters. At this time a buffer full signal is developed which still nevertheless permits the printer to accept 16 additional characters without actually overrunning the data memory. The printer will not release its data full condition until the memory register is unloaded down to 97 characters remaining in the buffer.

The BACKSPACE operation is shown in FIGS. 2, 4 and 4*a*. When a backspace code is detected in the output holding register 208, a backspace condition (binary 10) is loaded into the tab memory recirculating register 216. The Backspace Control gate 215D adds one extra stage to register 216. Register 216 is then recirculated through the backspace contol's extra stage until the backspace code (binary 10) appears at the output. This effectively retards the Tab Memory by one character position (i.e. the code word previously in the output stage of 216 is now one stage away from the output stage). When the next character is printed, the Tab Memory removes the backspace code from memory and internally recirculates the data again.

Figures 2, 3G:
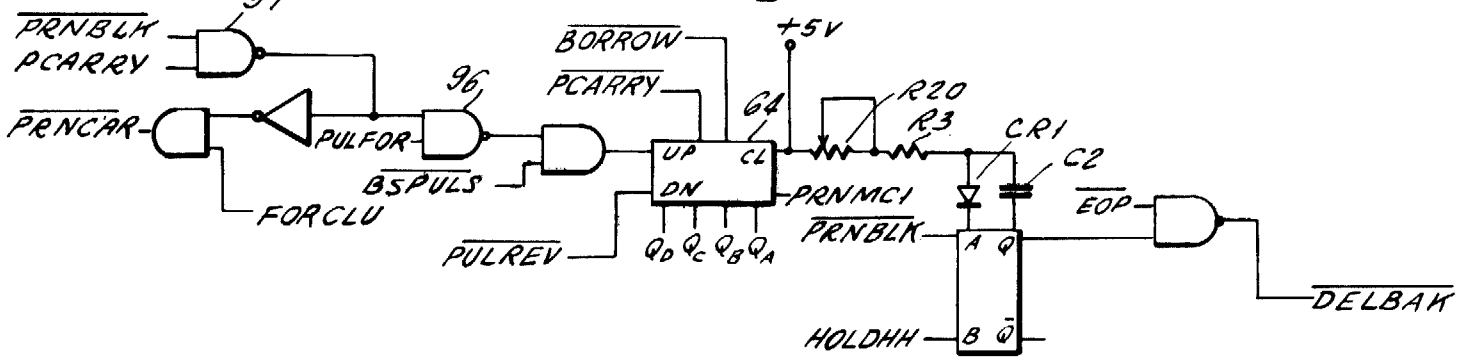

The backspace code also generates $\overline{BSPULS}$ (Backspace pulse) that will increment the relative position counter by one character count, gate 64 (note also FIG. 3*g*), causing the printer to overprint the last character position. $\overline{BSPULS}$ also causes the brake to release and the head to go through the motions of printing a character. This head motion is actually decrementing the head one character position. Obviously the operation is the same for receipt of a plurality of backspace codes.

As used in the following claims, the characters *n*, *m*, *p* are integers.

What is claimed is:

1. A dot matrix printer comprising:

a paper document holder for supporting a paper document;

a carriage assembly reciprocally movable across said document between end points spaced apart by an amount comprised of *m* equispaced character intervals;

a print head assembly mounted on said carriage assembly for printing successive dot columns wherein *n* dot columns represent a character interval;

means for selectively moving said carriage assembly in a forward or a reverse direction;

registration means associated with said paper document holder and having a predetermined pattern of at least *d* equispaced indicia wherein $d = n \times m$;

sensing means mounted on said carriage assembly for sensing said pattern to generate pulses representative of said pattern whenever said carriage is moving;

a *p* stage memory means, *p* being an integer greater than 1, for storing a plurality of code words, each code word representing a character to be printed and comprising a plurality of bits, the pth stage of said memory means being the output of said memory means;

means for advancing code words in said memory from one stage to the next each time said sensing means traverses a character interval;

means coupled to said sensing means for determining the direction of movement of said carriage;

monitoring means coupled to the output of said memory means to generate an enable signal whenever the output of said memory means is empty;

counting means coupled to said sensing means and said monitoring means and being respectively incremented or decremented from a predetermined count when said carriage assembly is moving respectively in the forward or the reverse direction and when said enabling signal is present;

said moving means comprising forward drive means for moving said carriage assembly in a forward direction during printing;

brake means for halting said carriage assembly;

means responsive to said enabling signal for disabling said forward drive means and including first delay means responsive to the disabling of said forward drive means for activating said brake means a predetermined time delay after disabling of said forward drive means to move said print head assembly beyond the last printed character to permit unimpeded observation thereof.

2. The printer of claim 1 further including reverse drive means;

said delay means further comprising means responsive to the absence of said enabling signal to release said brake means and activate said reverse drive means, said counting means being decremented when said carriage moves in the reverse direction;

means responsive to a zero count in said counting means for disabling said reverse drive means and activating said forward drive means whereby the print head moves to a position a plurality of character spaced to the left of the next print position until said forward drive means engages said carriage assembly to drive the print head in the forward direction to provide for printing on the fly.

3. Means for operating a printer of the dot matrix type for printing characters comprised of a first plurality of dot columns each column having a second plurality of dots;

input latch means for receiving code words identifying a character;

recirculating memory means having a plurality of stages each adapted to store a code word, the last stage of said recirculating memory means being the output thereof;

output latch means for receiving and storing code words;

means for loading a code word from said input latch means into said recirculating memory means;

means for advancing code words in said recirculating memory means to said output of said recirculating memory means;

means for transferring the code word in the output of said recirculating memory means into said output latch means;

means coupled to said output latch means for printing the character whose code is stored in said output latch means and for enabling said input latch means and memory means to receive additional code words during a printing operation.

4. Means for operating a printer of the dot matrix type for printing characters comprised of a first plurality of dot columns, each column having a second plurality of dots, said means comprising:

input means for receiving data code words identifying a character;

first recirculating memory means having a plurality of stages, each said stage adapted to store a data code word, a predetermined number of said stages representing dummy positions, the remaining said stages representing data positions, the last stage of said first recirculating memory means being the output thereof;

output latch means for receiving and storing data code words;

means for loading a data code word from said input means into said first recirculating memory means;

advancing means for advancing said data code words in said first recirculating memory means to said output of said first recirculating memory means;

means for transferring a data code word in said output of said first recirculating memory means into said output latch means;

means coupled to said output latch means for printing the character whose data code word is stored in said output latch means and enabling said input means and first recirculating memory means to receive additional data code words during a printing operation;

second recirculating memory means having a plurality of stages equal in number to the number of stages in said first recirculating memory means, each of said plurality of stages of said second recirculating memory means being adapted to store a multi-bit status code word representative of the status of an associated stage of said first recirculating memory means, each of said status code words indicating whether its associated stage of said first recirculating memory means is a data or a dummy position and whether there is data or no data in its associated state, the last stage of said second recirculating memory means being the output thereof;

said advancing means being coupled to said second recirculating memory means to advance status code words in said second recirculating memory means in synchronism with said first recirculating memory means;

means responsive to a code word being loaded into said input means for loading a multi-bit status code word into said second recirculating memory means when a data code word in said output of said first recirculating memory means is loaded into said output latch means;

means responsive to printing of a data code word in said output latch means for altering the status code word in said second recirculating memory means which is associated with said data code word in said output latch means to identify a no-data code;

means responsive to turn-off of the printer for loading a status code word representing no data in a dummy position into a plurality of stages of said second recirculating memory means;

bidirectional counting means coupled to the output of said second recirculating memory means for counting the number of stages in said first recirculating memory means containing data code words in either a data or a dummy position and for generating a full signal condition when a predetermined number of the stages containing data code words are counted to prevent the acceptance of further data code words from said input means.

5. The printer of claim 4 including means responsive o the presence of a status code word indicating the presence of data in a dummy position at the output of aid second recirculating memory means for down ounting said bidirectional counting means when the ssociated data code word in said output of said first ecirculating memory means is transferred into said utput latch means, said bidirectional counting means eing adapted to stop generating said full condition ignal when the count in said counter reaches a second redetermined value, said means responsive to the resence of a status code word also for altering the tatus code word associated with the data code word ransferred into said output latch means as said status ode word is recirculated from the output of said sec- nd recirculating memory means to an input thereof.

6. Tab control means for line printers comprising:

a carriage assembly reciprocally movable across a document between end points spaced apart by an amount comprised of *m* equispaced character intervals;

first moving means for selectively moving said carriage in first and second opposite directions;

a print head mounted on said carriage for printing dot columns wherein *n* successive dot columns collectively form a character;

registration means having a plurality of uniformly spaced slits;

means on said carriage for sensing said slits to generate pulses when said carriage moves in either direction;

recirculating memory means having *m* stages each adapted to store a code word representing a tab, no tab or end of line condition, said recirculating memory means having an output stage;

second memory means responsive to said sensing means for moving the contents stored in said stages of said recirculating memory means in a first direction as said carriage moves in said first direction;

means responsive to a tab set input for loading a tab code into the stage of said recirculating memory means associated with the position of the print head at the time said tab set input is received;

second means responsive to a tab input for moving said carriage in said first direction at a slew rate, whereby said sensing means advances the contents in said recirculating memory means in synchronism with the movement of said carriage;

means responsive to the presence of a tab code at said output stage of said recirculating memory means for stopping said carriage, whereupon said first moving means controls movement of said carriage at the print rate.

7. The printer of claim 6 wherein said sensing means further comprises direction sensing means for determining the direction of movement of said carriage;

said second moving means being disabled by said direction sensing means whenever said carriage is moving in said second direction.

8. A printer having:

head means for printing dot matrix type patterns;

means for selectively moving said head means in the forward or reverse direction;

first multi-stage recirculating memory means for storing data codes representing patterns to be printed and for storing function codes;

means coupled to the output of said first recirculating means for converting data codes into pattern signals coupled to said head means;

means responsive to printing of a pattern for advancing the data in said first memory means by one stage;

registration means responsive to movement of said head means for generating registration signals;

up/down counter means;

means for monitoring the direction of movement of said head means;

means for generating an enabling signal whenever the output stage of said memory means is empty;

said up/down counter means being responsive to said enabling means and said registration means for being incremented or decremented whenever said head means is moving in respectively the forward or reverse direction and is not printing;

means for halting the print head means at least a predetermined distance from he last printed pattern;

means responsive to a backspace code in the output of said memory means for incrementing said up/down counter means by one count;

means for enabling said print head means to print patterns only when said up/down counter means reaches a zero count whereby the last printed character(s) is (are) printed over whenever backspace code(s) has been received.

* * * * *